US008622220B2

(12) United States Patent
Schulte, Jr. et al.

(10) Patent No.: US 8,622,220 B2
(45) Date of Patent: Jan. 7, 2014

(54) VIBRATORY SEPARATORS AND SCREENS

(75) Inventors: David Lee Schulte, Jr., Willis, TX (US); Thomas Robert Larson, Montgomery, TX (US); Paul William Dufilho, Willis, TX (US)

(73) Assignee: Varco I/P, Houston, TX (US)

( * ) Notice: Subject to any disclaimer, the term of this patent is extended or adjusted under 35 U.S.C. 154(b) by 701 days.

(21) Appl. No.: 11/897,975

(22) Filed: Aug. 31, 2007

(65) Prior Publication Data

US 2009/0057205 A1 Mar. 5, 2009

(51) Int. Cl.
*B07B 1/46* (2006.01)

(52) U.S. Cl.
USPC ..... 209/400

(58) Field of Classification Search
USPC ..... 209/400, 401, 403
See application file for complete search history.

(56) References Cited

U.S. PATENT DOCUMENTS

| | | | | |
|---|---|---|---|---|
| 399,616 | A | 3/1889 | Hurford | 209/401 |
| 485,488 | A | 11/1892 | Cockrell | 209/401 |
| 1,078,380 | A | 11/1913 | Reynolds | |
| 1,139,469 | A | 5/1915 | Potter | 209/401 |
| 1,304,918 | A | 5/1919 | Sweetland | |
| 1,459,845 | A | 6/1923 | Mitchell | |
| 1,830,792 | A | 11/1931 | Herrmann | 209/401 |
| 1,885,154 | A | 11/1932 | Strezynski et al. | |
| 1,886,174 | A | 11/1932 | Hazeltine | 209/269 |
| 1,997,713 | A | 4/1935 | Boehm | 298/401 |
| 2,081,513 | A | 6/1937 | Roberts | 210/76 |
| 2,089,548 | A | 8/1937 | Frantz et al. | 210/389 |
| 2,112,784 | A | 3/1938 | McNitt | 99/105 |
| 2,341,169 | A | 2/1944 | Wilson et al. | 73/51 |
| 2,418,529 | A | 4/1947 | Stern | 51/309 |
| 2,578,456 | A | 12/1951 | Smith | 233/7 |
| 2,653,521 | A | 9/1953 | Einarsson | 209/70 |
| 2,711,854 | A | 6/1955 | Kjellgren | 494/53 |
| 2,716,493 | A | 8/1955 | Hutchison | 209/269 X |

(Continued)

FOREIGN PATENT DOCUMENTS

| | | |
|---|---|---|
| DE | 4127929 A1 | 2/1993 |
| FR | 2 611 559 | 9/1988 |

(Continued)

OTHER PUBLICATIONS

Composite Catalog A Complete Line of Solids Control Equipment. Derrick Equipment Company. 28 pges. 2006.

(Continued)

*Primary Examiner* — Joseph C Rodriguez
(74) *Attorney, Agent, or Firm* — Williams, Morgan & Amerson, P.C.

(57) ABSTRACT

A screen for a vibratory separator includes at least two layers of screening material, at least one layer of screening material made of a plurality of intersecting wires having a coating containing nickel or chromium. Wires in the screening material including first shute wires and first warp wires at a right angles to each other. The first warp wires at a right angle to first shute wires, the second wires including second shute wires and second warp wires, each of the second shute wires at a right angle to second warp wires, and each of the second warp wires at a right angle to second shute wires. The first warp wires are aligned with second warp wires, and each of the first shute wires are aligned with a second shute wire.

29 Claims, 22 Drawing Sheets

(56) References Cited

U.S. PATENT DOCUMENTS

| | | | | |
|---|---|---|---|---|
| 2,750,043 | A | 6/1956 | Thompson | 210/149 |
| 2,895,669 | A | 7/1959 | Bobo | 494/10 |
| 2,919,898 | A | 1/1960 | Marwil et al. | 255/1.8 |
| 2,926,785 | A | 3/1960 | Sander | |
| 2,928,546 | A | 3/1960 | Church | 210/319 |
| 2,938,393 | A | 5/1960 | Dunn et al. | 74/61 |
| 2,942,731 | A | 6/1960 | Soldini | 209/293 |
| 2,955,753 | A | 10/1960 | O'Conor et al. | 494/5 |
| 2,961,154 | A | 11/1960 | Bergey | 494/1 |
| 2,973,865 | A | 5/1961 | Cibula | 209/315 |
| 3,012,674 | A | 12/1961 | Hoppe | 209/401 |
| 3,053,379 | A | 9/1962 | Roder et al. | 198/220 |
| 3,064,806 | A | 11/1962 | Tapani | 209/17 |
| 3,070,291 | A | 12/1962 | Bergey | 494/1 |
| 3,219,107 | A | 11/1965 | Brown et al. | 166/8 |
| 3,226,989 | A | 1/1966 | Robins | 74/87 |
| 3,268,159 | A | 8/1966 | Kern | 233/7 |
| 3,302,720 | A | 2/1967 | Brandon | 166/307 |
| 3,498,393 | A | 3/1970 | West et al. | 175/48 |
| 3,605,919 | A | 9/1971 | Bromell et al. | 175/27 |
| 3,629,859 | A | 12/1971 | Copland et al. | 340/172.5 |
| 3,640,344 | A | 2/1972 | Brandon | 166/307 |
| 3,659,465 | A | 5/1972 | Oshima et al. | 74/61 |
| 3,716,138 | A | 2/1973 | Lumsden | 209/401 |
| 3,726,136 | A | 4/1973 | McKean et al. | 73/155 |
| 3,795,361 | A | 3/1974 | Lee | 233/7 |
| 3,796,299 | A | 3/1974 | Musschoot | 198/220 |
| 3,855,380 | A | 12/1974 | Gordon et al. | 264/97 |
| 3,874,733 | A | 4/1975 | Poundstone et al. | 299/17 |
| 3,885,734 | A | 5/1975 | Lee | 233/3 |
| 3,900,393 | A | 8/1975 | Wilson | 209/399 |
| 3,934,792 | A | 1/1976 | High et al. | 233/7 |
| 3,955,411 | A | 5/1976 | Lawson, Jr. | 73/155 |
| 3,968,033 | A | 7/1976 | Illemann et al. | 209/403 |
| 3,993,146 | A | 11/1976 | Poundstone et al. | 175/206 |
| 4,000,074 | A | 12/1976 | Evans | 210/369 |
| 4,033,865 | A | 7/1977 | Derrick, Jr. | 209/275 |
| 4,038,152 | A | 7/1977 | Atkins | 201/2.5 |
| 4,082,657 | A | 4/1978 | Gage | 209/311 |
| 4,085,888 | A | 4/1978 | Jager | 233/7 |
| 4,115,507 | A | 9/1978 | Pico et al. | 264/267 |
| 4,116,288 | A | 9/1978 | Love | 175/66 |
| 4,192,743 | A | 3/1980 | Bastgen et al. | 210/712 |
| 4,208,906 | A | 6/1980 | Roberts, Jr. | 73/155 |
| 4,212,731 | A | 7/1980 | Wallin et al. | 209/366.5 |
| 4,222,988 | A | 9/1980 | Barthel | 422/309 |
| 4,224,821 | A | 9/1980 | Taylor et al. | 73/32 R |
| 4,228,949 | A | 10/1980 | Jackson | 233/7 |
| 4,233,181 | A | 11/1980 | Goller et al. | 252/425.3 |
| 4,240,578 | A | 12/1980 | Jackson | 233/7 |
| 4,297,225 | A | 10/1981 | Hartley | 210/779 |
| 4,298,160 | A | 11/1981 | Jackson | 233/7 |
| 4,298,162 | A | 11/1981 | Hohne | 233/7 |
| 4,298,572 | A | 11/1981 | Moffet et al. | 422/68 |
| 4,306,974 | A | 12/1981 | Harry | 210/388 |
| 4,319,482 | A | 3/1982 | Bunner | 73/153 |
| 4,319,991 | A | 3/1982 | Crone, Jr. et al. | 209/255 |
| 4,322,288 | A | 3/1982 | Schmidt | 209/356 |
| 4,339,072 | A | 7/1982 | Hiller | 233/7 |
| 4,350,591 | A | 9/1982 | Lee | 210/384 |
| 4,369,915 | A | 1/1983 | Oberg et al. | 494/8 |
| 4,378,906 | A | 4/1983 | Epper et al. | 494/54 |
| 4,380,494 | A | 4/1983 | Wilson | 290/319 |
| 4,411,074 | A | 10/1983 | Daly | 34/32 |
| 4,432,064 | A | 2/1984 | Barker et al. | 364/550 |
| 4,446,022 | A | 5/1984 | Harry | 210/388 |
| 4,459,207 | A | 7/1984 | Young | 209/269 |
| 4,482,459 | A | 11/1984 | Shiver | 210/639 |
| 4,491,517 | A | 1/1985 | Janovac | 209/401 |
| 4,495,065 | A | 1/1985 | DeReamer et al. | 209/243 |
| 4,526,687 | A | 7/1985 | Nugent | 210/202 |
| 4,536,286 | A | 8/1985 | Nugent | 210/202 |
| 4,546,783 | A | 10/1985 | Lott | 134/109 |
| 4,549,431 | A | 10/1985 | Soeiinah | 73/152.49 |
| 4,553,429 | A | 11/1985 | Evans et al. | 73/152.21 |
| 4,573,115 | A | 2/1986 | Halgrimson | 364/138 |
| 4,575,336 | A | 3/1986 | Mudd et al. | 432/72 |
| 4,575,421 | A | 3/1986 | Derrick et al. | 298/397 |
| 4,606,415 | A | 8/1986 | Gray, Jr. et al. | 175/24 |
| 4,624,417 | A | 11/1986 | Gangi | 241/17 |
| 4,634,535 | A | 1/1987 | Lott | 210/780 |
| 4,635,735 | A | 1/1987 | Crownover | 175/48 |
| 4,639,258 | A | 1/1987 | Schellstede et al. | 95/260 |
| 4,650,687 | A | 3/1987 | Willard et al. | 426/438 |
| 4,668,213 | A | 5/1987 | Kramer | 494/8 |
| 4,685,329 | A | 8/1987 | Burgess | 73/151 |
| 4,691,744 | A | 9/1987 | Haver et al. | 139/425 R |
| 4,696,353 | A | 9/1987 | Elmquist et al. | 175/206 |
| 4,696,751 | A | 9/1987 | Eifling | 210/780 |
| 4,729,548 | A | 3/1988 | Sullins | 266/44 |
| 4,743,226 | A | 5/1988 | Day et al. | 494/53 |
| 4,751,887 | A | 6/1988 | Terry et al. | 110/246 |
| 4,770,711 | A | 9/1988 | Deal, III et al. | 134/18 |
| 4,783,057 | A | 11/1988 | Sullins | 266/44 |
| 4,791,002 | A | 12/1988 | Baker et al. | 426/641 |
| 4,793,421 | A | 12/1988 | Jasinski | 175/27 |
| 4,795,552 | A | 1/1989 | Yun et al. | 209/319 |
| 4,799,987 | A | 1/1989 | Sullins | 156/425 |
| 4,805,659 | A | 2/1989 | Gunneweg et al. | 137/118 |
| 4,807,469 | A | 2/1989 | Hall | 73/155 |
| 4,809,791 | A | 3/1989 | Hayatdavoudi | 175/40 |
| 4,832,853 | A | 5/1989 | Shiraki et al. | 210/781 |
| 4,844,106 | A | 7/1989 | Hunter et al. | 134/73 |
| 4,846,352 | A | 7/1989 | Bailey | 209/399 |
| 4,857,176 | A | 8/1989 | Derrick et al. | 209/392 |
| 4,882,054 | A | 11/1989 | Derrick et al. | 210/389 |
| 4,889,733 | A | 12/1989 | Willard et al. | 426/438 |
| 4,889,737 | A | 12/1989 | Willard et al. | 426/550 |
| 4,895,665 | A | 1/1990 | Colelli et al. | 210/710 |
| 4,895,731 | A | 1/1990 | Baker et al. | 426/641 |
| 4,896,835 | A | 1/1990 | Fahrenholz | 241/74 |
| 4,911,834 | A | 3/1990 | Murphy | 210/167 |
| 4,915,452 | A | 4/1990 | Dibble | 299/17 |
| 4,940,535 | A | 7/1990 | Fisher et al. | 209/250 |
| 4,942,929 | A | 7/1990 | Malachosky et al. | 175/66 |
| 4,961,722 | A | 10/1990 | Taylor et al. | 494/36 |
| 5,010,966 | A | 4/1991 | Stokley et al. | 175/66 |
| 5,053,082 | A | 10/1991 | Flanigan et al. | 134/25.1 |
| 5,066,350 | A | 11/1991 | Sullins | 156/187 |
| 5,080,721 | A | 1/1992 | Flanigan et al. | 134/26 |
| 5,107,874 | A | 4/1992 | Flanigan et al. | 134/60 |
| 5,109,933 | A | 5/1992 | Jackson | 175/66 |
| 5,129,469 | A | 7/1992 | Jackson | 175/66 |
| 5,131,271 | A | 7/1992 | Haynes et al. | 73/290 |
| 5,145,256 | A | 9/1992 | Wiemers et al. | 366/336 |
| 5,147,277 | A | 9/1992 | Shapiro | 494/53 |
| 5,156,749 | A | 10/1992 | Williams | 210/770 |
| 5,156,751 | A | 10/1992 | Miller | 210/787 |
| 5,181,578 | A | 1/1993 | Lawler | 175/424 |
| 5,190,645 | A | 3/1993 | Burgess | 210/144 |
| 5,200,372 | A | 4/1993 | Kuroyama et al. | 501/96 |
| 5,203,762 | A | 4/1993 | Cooperstein | 494/7 |
| 5,221,008 | A | 6/1993 | Derrick, Jr. et al. | 209/269 |
| 5,226,546 | A | 7/1993 | Janssens et al. | 209/319 |
| 5,227,057 | A | 7/1993 | Lundquist | 210/174 |
| 5,229,018 | A | 7/1993 | Forrest | 252/8.551 |
| 5,232,099 | A | 8/1993 | Maynard | 209/311 |
| 5,253,718 | A | 10/1993 | Lawler | 175/20 |
| 5,256,291 | A | 10/1993 | Cagle | 210/499 |
| 5,265,730 | A | 11/1993 | Norris et al. | 209/326 |
| 5,273,112 | A | 12/1993 | Schultz | 166/374 |
| 5,278,549 | A | 1/1994 | Crawford | 340/853.2 |
| 5,314,058 | A | 5/1994 | Graham | 198/753 |
| 5,319,972 | A | 6/1994 | Oblak et al. | 73/290 |
| 5,329,465 | A | 7/1994 | Arcella et al. | 364/551.01 |
| 5,330,057 | A | 7/1994 | Schiller et al. | 209/392 |
| 5,332,101 | A | 7/1994 | Bakula | 209/403 |
| 5,337,966 | A | 8/1994 | Francis et al. | 241/46.06 |
| 5,370,797 | A | 12/1994 | Cagle | 210/499 |
| 5,378,364 | A | 1/1995 | Welling | 210/512.1 |
| 5,385,669 | A * | 1/1995 | Leone, Sr. | 210/488 |
| 5,392,925 | A | 2/1995 | Seyffert | 209/405 |
| 5,400,376 | A | 3/1995 | Trudeau | 377/21 |
| 5,403,260 | A | 4/1995 | Hensely | 494/53 |

(56) References Cited

U.S. PATENT DOCUMENTS

| | | | | |
|---|---|---|---|---|
| 5,417,793 | A | 5/1995 | Bakula | 156/308.2 |
| 5,417,858 | A | 5/1995 | Derrick et al. | 210/388 |
| 5,417,859 | A | 5/1995 | Bakula | 210/388 |
| 5,454,957 | A | 10/1995 | Roff | 210/768 |
| 5,465,798 | A | 11/1995 | Edlund et al. | 175/24 |
| 5,474,142 | A | 12/1995 | Bowden | 175/27 |
| 5,488,104 | A | 1/1996 | Schulz | 536/86 |
| 5,489,204 | A | 2/1996 | Conwell et al. | 432/153 |
| 5,494,584 | A | 2/1996 | McLachlan et al. | 210/739 |
| 5,516,348 | A | 5/1996 | Conwell et al. | 51/309 |
| 5,534,207 | A | 7/1996 | Burrus | 264/150 |
| 5,547,479 | A | 8/1996 | Conwell et al. | 51/309 |
| 5,566,889 | A | 10/1996 | Preiss | 241/19 |
| 5,567,150 | A | 10/1996 | Conwell et al. | 432/14 |
| 5,570,749 | A | 11/1996 | Reed | 175/66 |
| 5,593,582 | A | 1/1997 | Roff, Jr. | 210/325 |
| 5,597,042 | A | 1/1997 | Tubel et al. | 166/250.01 |
| 5,626,234 | A | 5/1997 | Cook et al. | 209/315 |
| 5,632,714 | A | 5/1997 | Leung et al. | 494/53 |
| 5,636,749 | A | 6/1997 | Wojciechowski | 209/403 |
| 5,638,960 | A | 6/1997 | Beuermann et al. | 209/397 |
| 5,641,070 | A | 6/1997 | Seyffert | 209/314 |
| 5,643,169 | A | 7/1997 | Leung et al. | 494/53 |
| 5,653,674 | A | 8/1997 | Leung | 494/53 |
| 5,662,165 | A | 9/1997 | Tubel et al. | 166/250.01 |
| 5,669,941 | A | 9/1997 | Peterson | 51/295 |
| 5,681,256 | A | 10/1997 | Nagafuji | 494/9 |
| D386,874 | S | 11/1997 | Glaun | D34/29 |
| D387,534 | S | 12/1997 | Glaun | D34/29 |
| D388,583 | S | 12/1997 | Glaun | D34/29 |
| 5,695,442 | A | 12/1997 | Leung et al. | 494/37 |
| 5,699,918 | A | 12/1997 | Dunn | 209/397 |
| D388,924 | S | 1/1998 | Glaun | D34/29 |
| 5,706,896 | A | 1/1998 | Tubel et al. | 166/313 |
| 5,720,881 | A | 2/1998 | Derrick et al. | 210/388 |
| 5,730,219 | A | 3/1998 | Tubel et al. | 166/250.01 |
| 5,732,776 | A | 3/1998 | Tubel et al. | 166/250.15 |
| 5,732,828 | A | 3/1998 | Littlefield, Jr. | 209/365.1 |
| 5,771,601 | A | 6/1998 | Veal et al. | 34/314 |
| 5,772,573 | A | 6/1998 | Hao | 494/15 |
| 5,783,077 | A | 7/1998 | Bakula | 210/388 |
| 5,791,494 | A | 8/1998 | Meyer | 209/368 |
| 5,793,705 | A | 8/1998 | Gazis et al. | 367/98 |
| 5,811,003 | A | 9/1998 | Young et al. | 210/388 |
| 5,814,218 | A | 9/1998 | Cagle | 210/388 |
| 5,814,230 | A | 9/1998 | Willis et al. | 210/710 |
| 5,819,952 | A | 10/1998 | Cook et al. | 209/400 |
| 5,839,521 | A | 11/1998 | Dietzen | 100/37 |
| 5,857,955 | A | 1/1999 | Phillips | 494/7 |
| 5,861,362 | A | 1/1999 | Mayeux et al. | 507/104 |
| 5,868,125 | A | 2/1999 | Maoujoud | 125/15 |
| 5,868,929 | A | 2/1999 | Derrick et al. | 210/388 |
| 5,876,552 | A | 3/1999 | Bakula | 156/308 |
| 5,896,998 | A | 4/1999 | Bjorklund et al. | 209/326 |
| 5,899,844 | A | 5/1999 | Eberle, Sr. | 494/37 |
| 5,913,767 | A | 6/1999 | Feldkamp et al. | 494/4 |
| 5,919,123 | A | 7/1999 | Phillips | 494/7 |
| 5,942,130 | A | 8/1999 | Leung | 210/784 |
| 5,944,197 | A | 8/1999 | Baltzer et al. | 209/400 |
| 5,944,993 | A | 8/1999 | Derrick et al. | 210/388 |
| 5,948,256 | A | 9/1999 | Leung | 210/374 |
| 5,948,271 | A | 9/1999 | Wardwell et al. | 210/739 |
| 5,952,569 | A | 9/1999 | Jervis et al. | 73/152.01 |
| 5,955,666 | A | 9/1999 | Mullins | 73/152.18 |
| 5,958,235 | A | 9/1999 | Leung | 210/374 |
| 5,958,236 | A | 9/1999 | Bakula | 210/388 |
| 5,971,159 | A | 10/1999 | Leone et al. | 209/399 |
| 5,971,307 | A | 10/1999 | Davenport | 241/259.1 |
| 5,975,204 | A | 11/1999 | Tubel et al. | 166/250.15 |
| 5,992,519 | A | 11/1999 | Ramakrishnan et al. | 166/250.15 |
| 6,000,556 | A | 12/1999 | Bakula | 210/388 |
| 6,012,016 | A | 1/2000 | Bilden et al. | 702/12 |
| 6,013,158 | A | 1/2000 | Wootten | 202/99 |
| 6,021,377 | A | 2/2000 | Dubinsky et al. | 702/9 |
| 6,024,228 | A | 2/2000 | Williams | 209/272 |
| 6,032,806 | A | 3/2000 | Leone et al. | 209/402 |
| 6,045,070 | A | 4/2000 | Davenport | 241/60 |
| 6,053,332 | A | 4/2000 | Bakula | 210/388 |
| 6,062,070 | A | 5/2000 | Maltby et al. | 73/61.49 |
| 6,063,292 | A | 5/2000 | Leung | 210/739 |
| 6,089,380 | A | 7/2000 | Hazrati et al. | 210/411 |
| 6,102,310 | A | 8/2000 | Davenport | 241/21 |
| 6,105,689 | A | 8/2000 | McGuire et al. | 175/48 |
| 6,109,452 | A | 8/2000 | Leung et al. | 210/369 |
| 6,110,096 | A | 8/2000 | Leung et al. | 494/53 |
| 6,123,656 | A | 9/2000 | Michelsen | 494/54 |
| 6,138,834 | A | 10/2000 | Southall | 209/17 |
| 6,143,183 | A | 11/2000 | Wardwell et al. | 210/739 |
| 6,145,669 | A | 11/2000 | Leung | 210/374 |
| 6,155,428 | A | 12/2000 | Bailey et al. | 209/315 |
| 6,161,700 | A | 12/2000 | Bakula | 209/401 |
| 6,165,323 | A | 12/2000 | Shearer | 162/251 |
| 6,170,580 | B1 | 1/2001 | Reddoch | 175/66 |
| 6,173,609 | B1 | 1/2001 | Modlin et al. | 73/293 |
| 6,176,323 | B1 | 1/2001 | Weirich et al. | 175/40 |
| 6,179,128 | B1 | 1/2001 | Seyffert | 209/405 |
| 6,192,742 | B1 | 2/2001 | Miwa et al. | 73/40 |
| 6,192,980 | B1 | 2/2001 | Tubel et al. | 166/65.1 |
| 6,217,830 | B1 | 4/2001 | Roberts et al. | 422/140 |
| 6,220,448 | B1 | 4/2001 | Bakula et al. | 209/392 |
| 6,220,449 | B1 | 4/2001 | Schulte, Jr. et al. | 209/401 |
| 6,223,906 | B1 | 5/2001 | Williams | 210/400 |
| 6,233,524 | B1 | 5/2001 | Harrell et al. | 702/9 |
| 6,234,250 | B1 | 5/2001 | Green et al. | 166/250.03 |
| 6,237,404 | B1 | 5/2001 | Crary et al. | 73/152.03 |
| 6,237,780 | B1 | 5/2001 | Schulte | 210/388 |
| 6,267,250 | B1 | 7/2001 | Leung et al. | 210/369 |
| 6,279,471 | B1 | 8/2001 | Reddoch | 100/37 |
| D448,488 | S | 9/2001 | Chaffiotte et al. | D24/219 |
| 6,283,302 | B1 * | 9/2001 | Schulte et al. | 209/399 |
| 6,290,636 | B1 | 9/2001 | Hiller, Jr. et al. | 494/53 |
| 6,308,787 | B1 | 10/2001 | Alft | 175/48 |
| 6,315,894 | B1 | 11/2001 | Wiemers et al. | 210/96.1 |
| 6,333,700 | B1 | 12/2001 | Thomeer et al. | 340/854.8 |
| 6,346,813 | B1 | 2/2002 | Kleinberg | 324/303 |
| 6,349,834 | B1 | 2/2002 | Carr et al. | 209/366.5 |
| 6,352,159 | B1 | 3/2002 | Loshe | 209/268 |
| 6,356,205 | B1 | 3/2002 | Salvo et al. | 340/853.3 |
| 6,367,633 | B1 | 4/2002 | Douglas | 209/311 |
| 6,368,264 | B1 | 4/2002 | Phillips et al. | 494/5 |
| 6,371,301 | B1 | 4/2002 | Schulte et al. | 209/405 |
| 6,371,306 | B2 | 4/2002 | Adams et al. | 320/388 |
| 6,378,628 | B1 | 4/2002 | McGuire et al. | 175/48 |
| 6,393,363 | B1 | 5/2002 | Wilt et al. | 702/6 |
| 6,399,851 | B1 | 6/2002 | Siddle | 203/87 |
| 6,408,953 | B1 | 6/2002 | Goldman et al. | 175/39 |
| 6,412,644 | B1 | 7/2002 | Crabbe et al. | 209/309 |
| 6,429,653 | B1 | 8/2002 | Kruspe et al. | 324/303 |
| 6,431,368 | B1 | 8/2002 | Carr | 209/403 |
| 6,438,495 | B1 | 8/2002 | Chau et al. | 702/9 |
| 6,439,391 | B1 | 8/2002 | Seyffert | 209/238 |
| 6,439,392 | B1 | 8/2002 | Baltzer | 209/405 |
| 6,461,286 | B1 | 10/2002 | Beatley | 494/8 |
| 6,474,143 | B1 | 11/2002 | Herod | 73/54.01 |
| 6,484,088 | B1 | 11/2002 | Reimer | 701/123 |
| 6,485,640 | B2 | 11/2002 | Fout et al. | 210/188 |
| 6,505,682 | B2 | 1/2003 | Brockman | 166/250.15 |
| 6,506,310 | B2 | 1/2003 | Kulbeth | 210/780 |
| 6,510,947 | B1 | 1/2003 | Schulte et al. | 210/388 |
| 6,513,664 | B1 | 2/2003 | Logan et al. | 209/367 |
| 6,517,733 | B1 | 2/2003 | Carlson | 210/785 |
| 6,519,568 | B1 | 2/2003 | Harvey et al. | 705/1 |
| 6,530,482 | B1 | 3/2003 | Wiseman | 209/253 |
| 6,536,540 | B2 | 3/2003 | deBoer | 175/70 |
| 6,553,316 | B2 | 4/2003 | Bary et al. | 702/16 |
| 6,553,336 | B1 | 4/2003 | Johnson et al. | 702/188 |
| 6,575,304 | B2 | 6/2003 | Cudahy | 209/365.3 |
| 6,581,455 | B1 | 6/2003 | Berger et al. | 73/152.55 |
| 6,600,278 | B1 | 7/2003 | Bretzius | 318/34 |
| 6,601,709 | B2 * | 8/2003 | Schulte et al. | 209/397 |
| 6,605,029 | B1 | 8/2003 | Koch et al. | 494/53 |
| 6,662,952 | B2 | 12/2003 | Adams et al. | 209/319 |
| 6,669,027 | B1 | 12/2003 | Mooney et al. | 209/405 |
| 6,679,385 | B2 | 1/2004 | Suter et al. | 209/367 |

(56) References Cited

U.S. PATENT DOCUMENTS

| | | | | |
|---|---|---|---|---|
| 6,691,025 | B2 | 2/2004 | Reimer | 701/123 |
| 6,692,599 | B2 | 2/2004 | Cook et al. | 156/94 |
| 6,693,553 | B1 | 2/2004 | Ciglenec et al. | 340/853.1 |
| 6,715,612 | B1 | 4/2004 | Krystof | 209/331 |
| 6,722,504 | B2 | 4/2004 | Schulte et al. | 209/359 |
| 6,746,602 | B2 | 6/2004 | Fout et al. | 210/188 |
| 6,763,605 | B2 | 7/2004 | Reddoch | 34/58 |
| 6,766,254 | B1 | 7/2004 | Bradford et al. | 702/9 |
| 6,769,550 | B2 | 8/2004 | Adams et al. | 209/399 |
| 6,780,147 | B2 | 8/2004 | Koch et al. | 494/53 |
| 6,783,088 | B1 | 8/2004 | Gillis et al. | 241/19 |
| 6,783,685 | B2 | 8/2004 | Huang | 210/690 |
| 6,790,169 | B2 | 9/2004 | Koch et al. | 494/53 |
| 6,793,814 | B2 | 9/2004 | Fout et al. | 210/188 |
| 6,808,626 | B2 | 10/2004 | Kulbeth | 210/241 |
| 6,825,136 | B2 | 11/2004 | Cook et al. | 442/6 |
| 6,827,223 | B2 | 12/2004 | Colgrove et al. | 209/365.3 |
| 6,838,008 | B2 | 1/2005 | Fout et al. | 210/780 |
| 6,860,845 | B1 | 3/2005 | Miller et al. | 494/1 |
| 6,863,183 | B2 | 3/2005 | Schulte et al. | 209/405 |
| 6,863,809 | B2 | 3/2005 | Smith et al. | 210/202 |
| 6,868,920 | B2 | 3/2005 | Hoteit et al. | 175/25 |
| 6,868,972 | B2 | 3/2005 | Seyffert et al. | 209/254 |
| 6,873,267 | B1 | 3/2005 | Tubel et al. | 340/853.3 |
| 6,892,812 | B2 | 5/2005 | Niedermayr et al. | 166/250.15 |
| 6,896,055 | B2 | 5/2005 | Koithan | 166/250.15 |
| 6,899,178 | B2 | 5/2005 | Tubel | 166/313 |
| 6,905,452 | B1 | 6/2005 | Kirsch | 494/8 |
| 6,907,375 | B2 | 6/2005 | Guggari et al. | 702/113 |
| 6,926,101 | B2 | 8/2005 | deBoer | 175/70 |
| 6,932,169 | B2 | 8/2005 | Wylie et al. | 175/66 |
| 6,932,757 | B2 | 8/2005 | Beattey | 494/55 |
| 6,971,982 | B1 | 12/2005 | Kirsch | 494/8 |
| 6,981,940 | B2 | 1/2006 | Rafferty | 494/7 |
| 7,001,324 | B2 | 2/2006 | Hensley et al. | 494/53 |
| 7,018,326 | B2 | 3/2006 | Koch et al. | 494/53 |
| 7,041,044 | B2 | 5/2006 | Gilbert | 494/53 |
| D524,825 | S | 7/2006 | Koch et al. | D15/21 |
| 7,093,678 | B2 | 8/2006 | Risher et al. | 175/66 |
| 7,144,516 | B2 | 12/2006 | Smith | 210/803 |
| 7,175,027 | B2 | 2/2007 | Strong et al. | 209/405 |
| 7,195,084 | B2 | 3/2007 | Burnett et al. | 175/66 |
| 7,198,156 | B2 | 4/2007 | Schulte et al. | 209/309 |
| 7,216,767 | B2 | 5/2007 | Schulte et al. | 209/309 |
| 7,216,768 | B2 | 5/2007 | Fisher et al. | 209/309 |
| 7,228,971 | B2 | 6/2007 | Mooney et al. | 209/396 |
| 7,264,125 | B2 | 9/2007 | Lipa | 209/397 |
| 7,284,665 | B2 | 10/2007 | Fuchs | 209/270 |
| 7,303,079 | B2 | 12/2007 | Reid-Robertson et al. | 209/405 |
| 7,306,057 | B2 | 12/2007 | Strong et al. | 175/66 |
| 7,316,321 | B2 | 1/2008 | Robertson et al. | 209/400 |
| 7,337,860 | B2 | 3/2008 | McIntyre | 175/66 |
| 7,373,996 | B1 | 5/2008 | Martin et al. | 175/206 |
| 7,387,602 | B1 | 6/2008 | Kirsch | 494/8 |
| 7,514,011 | B2 | 4/2009 | Kulbeth | 210/780 |
| 7,540,837 | B2 | 6/2009 | Scott et al. | 494/7 |
| 7,540,838 | B2 | 6/2009 | Scott et al. | 494/7 |
| 7,581,569 | B2 | 9/2009 | Beck | 139/425 R |
| 7,770,665 | B2 | 8/2010 | Eia et al. | 175/66 |
| 2001/0032815 | A1 | 10/2001 | Adams et al. | 210/388 |
| 2002/0000399 | A1 | 1/2002 | Winkler et al. | 209/399 |
| 2002/0018399 | A1 | 2/2002 | Schultz et al. | 361/81 |
| 2002/0033278 | A1 | 3/2002 | Reddoch | 175/57 |
| 2002/0033358 | A1 | 3/2002 | Bakula | 209/331 |
| 2002/0035551 | A1 | 3/2002 | Sherwin et al. | 705/412 |
| 2002/0074121 | A1 | 6/2002 | Schick et al. | 705/8 |
| 2002/0112888 | A1 | 8/2002 | Leuchtenberg | 175/48 |
| 2002/0134709 | A1 | 9/2002 | Riddle | 209/238 |
| 2003/0015351 | A1 | 1/2003 | Goldman et al. | 175/39 |
| 2003/0038734 | A1 | 2/2003 | Hirsch et al. | 340/853.1 |
| 2003/0109951 | A1 | 6/2003 | Hsiung et al. | 700/108 |
| 2003/0220742 | A1 | 11/2003 | Niedermayr et al. | 702/9 |
| 2004/0040746 | A1 | 3/2004 | Niedermayr et al. | 175/38 |
| 2004/0051650 | A1 | 3/2004 | Gonsoulin et al. | 340/853.1 |
| 2004/0156920 | A1 | 8/2004 | Kane | 424/725 |
| 2004/0245155 | A1 | 12/2004 | Strong et al. | 209/405 |
| 2005/0067327 | A1 | 3/2005 | Adams et al. | 209/408 |
| 2005/0103689 | A1 | 5/2005 | Schulte, Jr. et al. | 209/405 |
| 2005/0236305 | A1 | 10/2005 | Schulte, Jr. et al. | 209/403 |
| 2005/0255186 | A1 | 11/2005 | Hiraga | 425/542 |
| 2006/0019812 | A1 | 1/2006 | Stalwick | 494/42 |
| 2006/0034988 | A1 | 2/2006 | Bresnahan et al. | 426/502 |
| 2006/0081508 | A1 | 4/2006 | Astleford et al. | 209/309 |
| 2006/0102390 | A1 | 5/2006 | Burnett et al. | 175/66 |
| 2006/0105896 | A1 | 5/2006 | Smith et al. | 494/7 |
| 2006/0144779 | A1 | 7/2006 | Bailey | 210/330 |
| 2007/0108106 | A1 | 5/2007 | Burnett | 209/325 |
| 2007/0131592 | A1 | 6/2007 | Browne et al. | 209/399 |
| 2008/0078697 | A1 | 4/2008 | Carr | 209/49 |
| 2008/0078702 | A1 | 4/2008 | Carr et al. | 209/326 |
| 2008/0078704 | A1 | 4/2008 | Carr et al. | 209/399 |
| 2008/0093269 | A1 | 4/2008 | Timmerman et al. | 209/405 |
| 2008/0179090 | A1 | 7/2008 | Eia et al. | 175/5 |
| 2008/0179096 | A1 | 7/2008 | Eia et al. | 175/66 |
| 2008/0179097 | A1 | 7/2008 | Eia et al. | 175/66 |
| 2009/0105059 | A1 | 4/2009 | Dorry et al. | 494/37 |
| 2009/0178978 | A1 | 7/2009 | Beebe et al. | 210/747 |
| 2009/0242466 | A1 | 10/2009 | Burnett et al. | 209/555 |
| 2009/0286098 | A1 | 11/2009 | Yajima et al. | 428/507 |
| 2009/0316084 | A1 | 12/2009 | Yajima et al. | 349/96 |
| 2010/0084190 | A1 | 4/2010 | Eia et al. | 175/5 |
| 2010/0089802 | A1 | 4/2010 | Burnett | 209/360 |
| 2010/0119570 | A1 | 5/2010 | Potter et al. | 424/422 |

FOREIGN PATENT DOCUMENTS

| | | | |
|---|---|---|---|
| FR | 2 636 669 | | 3/1990 |
| GB | 1 526 663 | | 9/1978 |
| GB | 2 030 482 | A | 4/1980 |
| GB | 1 578 948 | | 11/1980 |
| GB | 2 176 424 | A | 12/1986 |
| GB | 2 327 442 | A | 1/1999 |
| JP | 55112761 | | 8/1980 |
| JP | 59069268 | | 4/1984 |
| JP | 63003090 | | 1/1988 |
| JP | 63283860 | | 11/1988 |
| JP | 63290705 | | 11/1988 |
| JP | 02127030 | | 5/1990 |
| JP | 02167834 | | 6/1990 |
| JP | 03240925 | | 10/1991 |
| JP | 03264263 | | 11/1991 |
| JP | 04093045 | | 3/1992 |
| JP | 04269170 | | 9/1992 |
| JP | 05043884 | | 2/1993 |
| JP | 05301158 | | 11/1993 |
| JP | 06063499 | | 3/1994 |
| JP | 07304028 | | 11/1995 |
| JP | 08039428 | | 2/1996 |
| JP | 08270355 | | 10/1996 |
| JP | 09109032 | | 4/1997 |
| JP | 10337598 | | 12/1998 |
| WO | WO96/08301 | | 3/1996 |
| WO | WO96/33792 | | 3/1996 |
| WO | WO98/10895 | | 3/1998 |
| WO | WO98/16328 | | 3/1998 |
| WO | WO 02/49778 | | 6/2002 |
| WO | WO 03/055569 | | 7/2003 |
| WO | WO2004/110589 | A1 | 12/2004 |
| WO | WO2005/107963 | A2 | 11/2005 |
| WO | WO2007/070559 | A2 | 6/2007 |
| WO | WO2009/048783 | A2 | 4/2009 |

OTHER PUBLICATIONS

Derrick Pyramid Screens, Derrick Corporation. 4 pages, 1994.

Composite Catalog A Complete Line of Solids Control Equipment. Derrick Equipment Company. 20 pages, 2002.

Layered shale shaker screens improve mud solids control. Cagle et al, Derrick Equipment Co., 7 pages, 1978.

An Innovative Method of Ranking Shale Shaker Screens, Morrison. Derrick Equipment Company. 4 pages, 1991.

Principles of High Speed Screening and Screen Machine Design. Derrick Manufacturing Corporation, 4 pages, 1981.

(56) References Cited

OTHER PUBLICATIONS

Derrick Screens. Derrick Manufacturing Corporation, 9 pages, 1992.
Handbook of Replacement Screen Surfaces and Accessories for Vibrating Motor Derrick Screening Machines High Speed Screening Machines. Derrick Manufacturing Corporation, 12 pages 1993.
Derrick Pyramid Screens, Derrick Equipment Company. 2 pages, 1993.
PCT/GB2008/050761 International Search Report (Sep. 17, 2009).
Letter. John J. Bakula, Derrick Corporation, to Guy McClung, 1 p., Mar. 11, 2009.
"Innovation by Design—Screen Surfaces & Accessories," Derrick Corporation, Front Cover, pp. 2-14, Back Cover, undated.
U.S. Appl. No. 12/481,959 Final Office Action dated Oct. 27, 2010.
U.S. Appl. No. 12/481,959 Office Action dated Jun. 7, 2010.
U.S. Appl. No. 12/469,851 Final Office Action dated Nov. 9, 2010.
U.S. Appl. No. 12/469,851 Office Action dated Jun. 28, 2010.
U.S. Appl. No. 12/227,462 Office Action dated Nov. 15, 2010.
U.S. Appl. No. 11/897,976 Final Office Action dated Sep. 1, 2010.
U.S. Appl. No. 11/897,976 Office Action dated Apr. 1, 2010.
U.S. Appl. No. 11/637,615 Final Office Action dated Aug. 2, 2010.
U.S. Appl. No. 11/637,615 Office Action dated Mar. 2, 2010.
Polyamide 6/6—Nylon 6/6—PA 6/6 60% Glass Fibre Reinforced, Data Sheet [online], AZoM™, The A to Z of Materials and AZojomo, The "AZo Journal of Materials Online" [retrieved on Nov. 23, 2005] (2005) (Retrieved from the Internet: <URL: http://web.archive.org/web/20051123025735/http://www.azom.com/details.asp?ArticleID=493>.
U.S. Appl. No. 12/785,735 Office Action dated Dec. 9, 2011.
U.S. Appl. No. 12/490,492 Office Action dated Oct. 7, 2011.
U.S. Appl. No. 12/321,358 Final Office Action dated Jan. 18, 2012.
U.S. Appl. No. 12/321,358 Office Action dated Aug. 29, 2011.
U.S. Appl. No. 12/287,716 Office Action dated Jun. 17, 2011.
U.S. Appl. No. 12/287,709 Office Action dated Mar. 29, 2011.
U.S. Appl. No. 12/231,293 Office Action dated Sep. 13, 2011.
U.S. Appl. No. 12/228,670 Office Action dated Jun. 20, 2011.
U.S. Appl. No. 12/227,462 Final Office Action dated May 26, 2011.
U.S. Appl. No. 12/008,980 Office Action dated Aug. 31, 2011.
U.S. Appl. No. 12/008,980 Office Action dated Apr. 5, 2011.
U.S. Appl. No. 12/001,479 Final Office Action dated Oct. 31, 2011.
U.S. Appl. No. 12/001,479 Office Action dated Jun. 8, 2011.
U.S. Appl. No. 11/637,615 Final Office Action dated Nov. 16, 2011.
U.S. Appl. No. 11/637,615 Office Action dated Jul. 21, 2011.
International Search Report and Written Opinion from PCT/GB2010/051050 dated Jan. 30, 2012.
EP Application No. 07 733 775.6 EPC Communication dated Dec. 9, 2010.
Adams et al., "The Advanced Technology Linear Separator Model ATL-1000," Drexel Oilfield Services, STC 03, 18 pages (1991).
AMS 2000 Description, Thule Rigtech, Rig Technology, 18 pages (2000).
Automated Chemical Additive System, Thule Rigtech, Rig Technology Ltd., 4 pages (2000).
Brandt Automated Shaker Control, Varco, 1 page (2002).
Brandt®, A Varco Company, King Cobra Series, Installation, Operation, and Maintenance Manual, M12444 R5, 65 pages (2003).
Brandt®, A Varco Company, LCM-2D LP Installation and Operation Manual, 84 pages (1998).
Brandt et al., Mud Equipment Manual—Handbook 3: Shale Shakers, Gulf Pub. Co., 18 pages (1982).
The Derrick LP Sandwich Shaker, Derrick Equipment Company, 4 pages (1981).
Fluid Systems Inc., The Prodigy Series I™ Dynamic Control Shaker, 2 pages (Apr. 27, 2004).
Sweco® Oilfield Services, LM-3 Full-Flo™ Shale Shaker, 4 pages (1991).
Axiom Ax-1 Shaker Brochure, 24 pages (2010).
Brandt, VSM-300™ Shaker Brochure, 4 pages (2001).
Brandt, VSM—Ultra Shaker Brochure, 2 pages (2003).

* cited by examiner 10
d
j
e
k
11
f
l
12

12
10
11

13
13
13
m
n
14
14
o
15

16
p
17
q
18
r

FIG. 3H
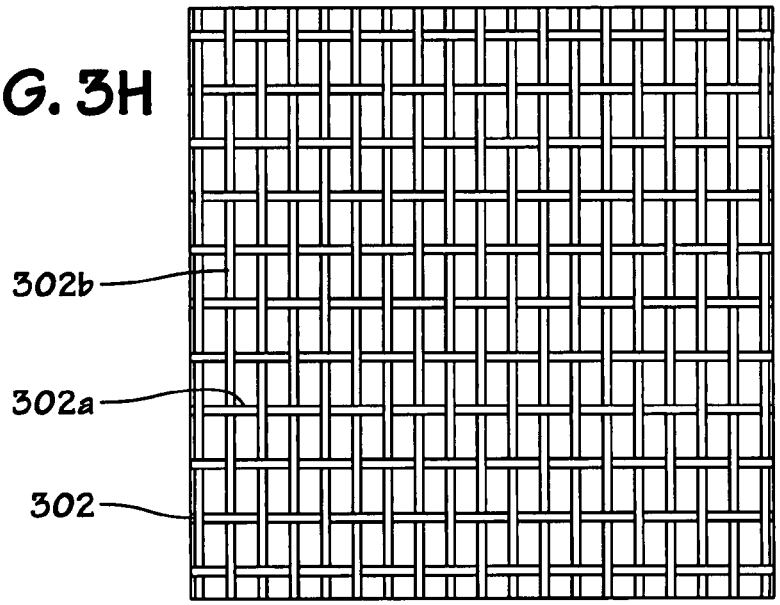
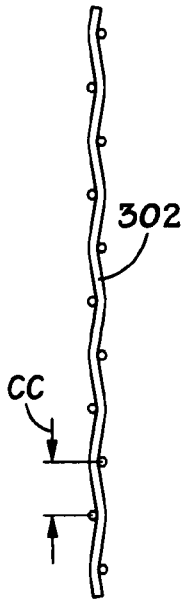
FIG. 3J
FIG. 3I
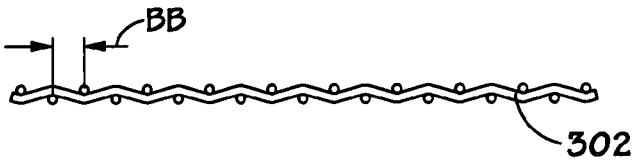
FIG. 3K
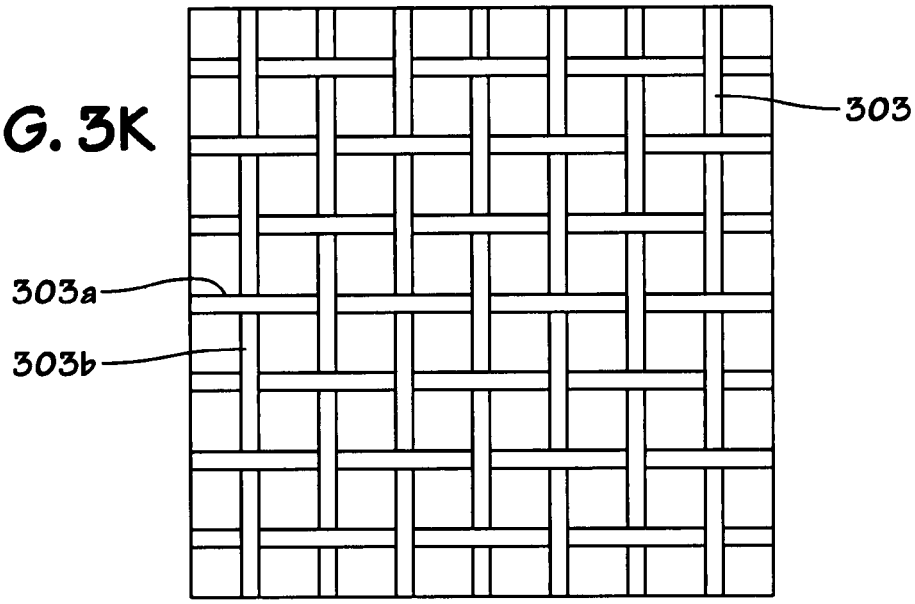
FIG. 3L
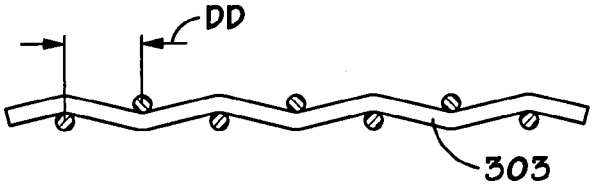

FIG. 4H
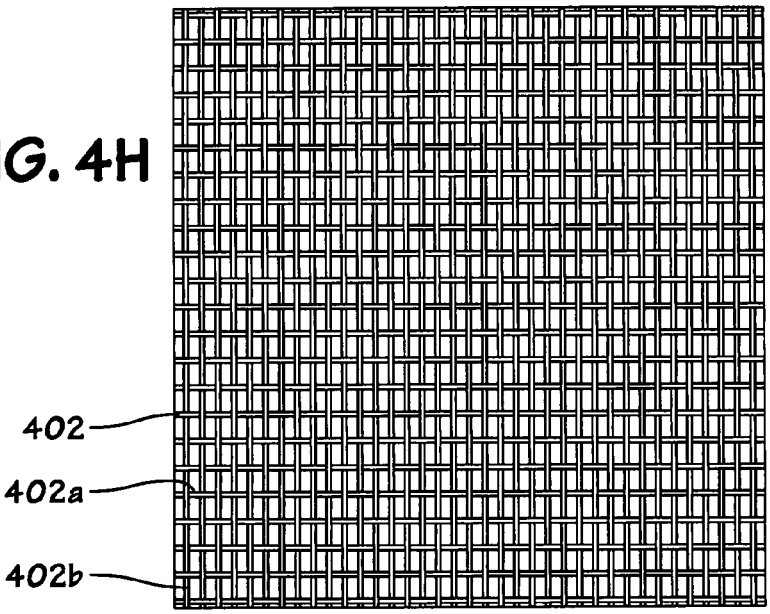
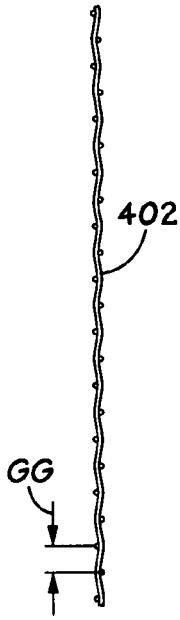
FIG. 4J
FIG. 4I
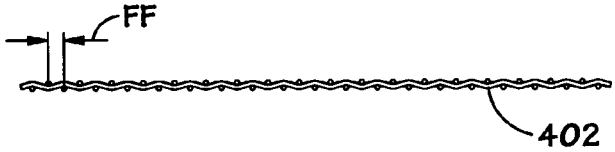
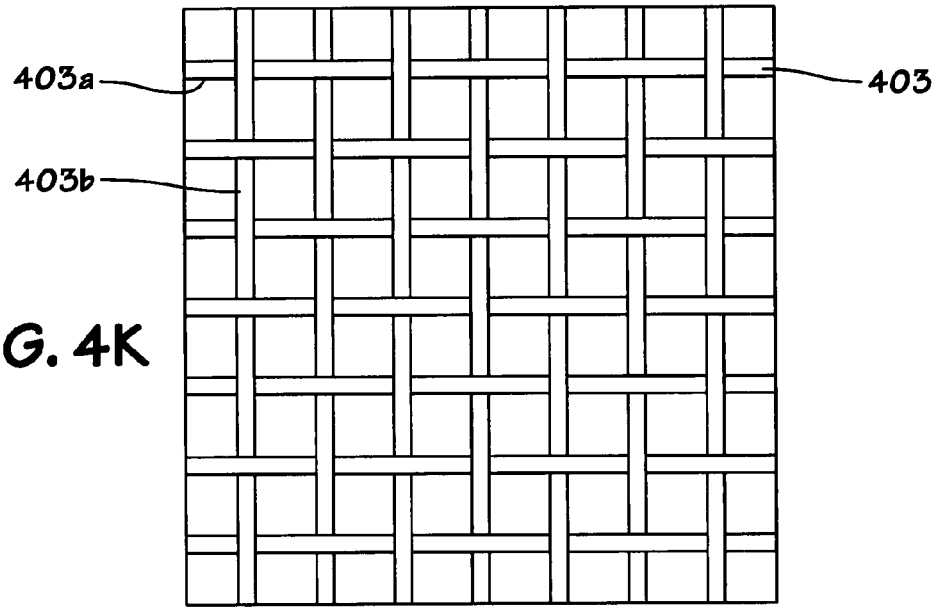
FIG. 4K
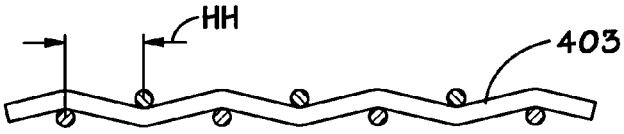
FIG. 4L FIG. 5A
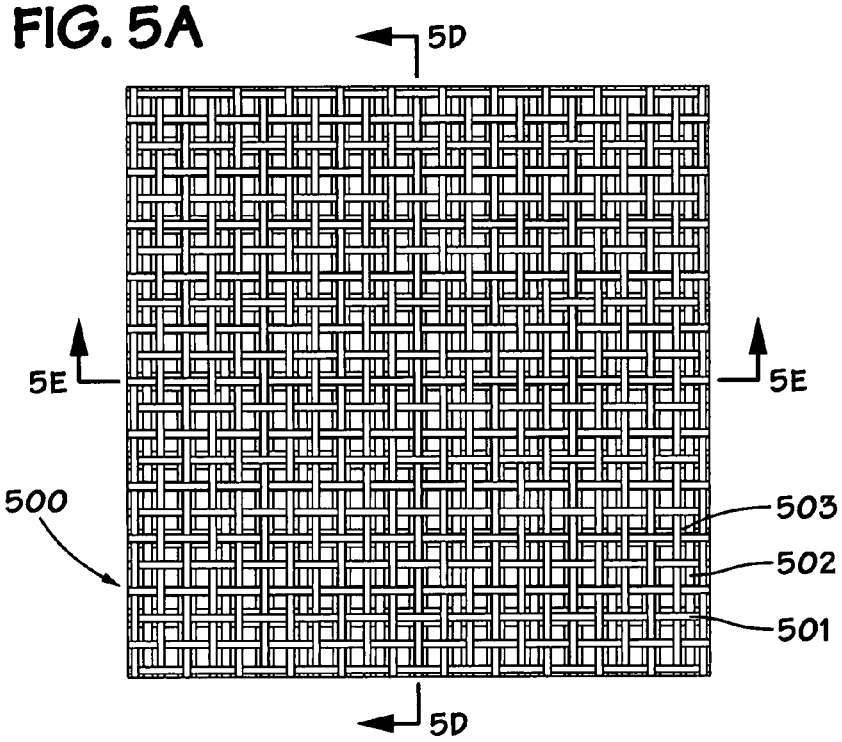
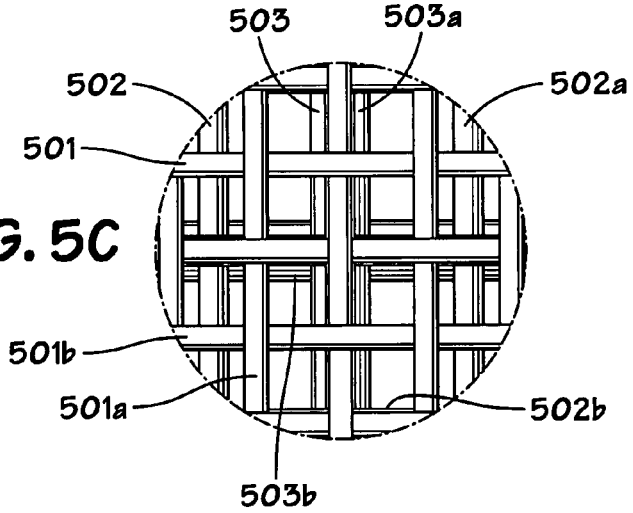
FIG. 5C
FIG. 5E
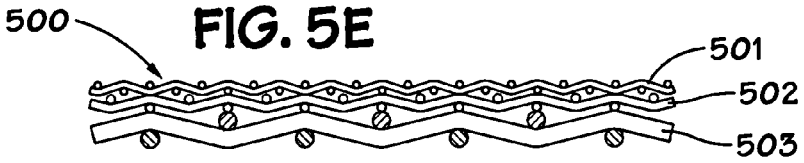
FIG. 5D
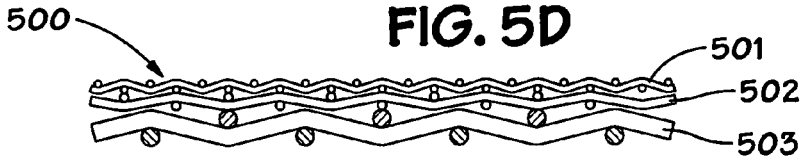

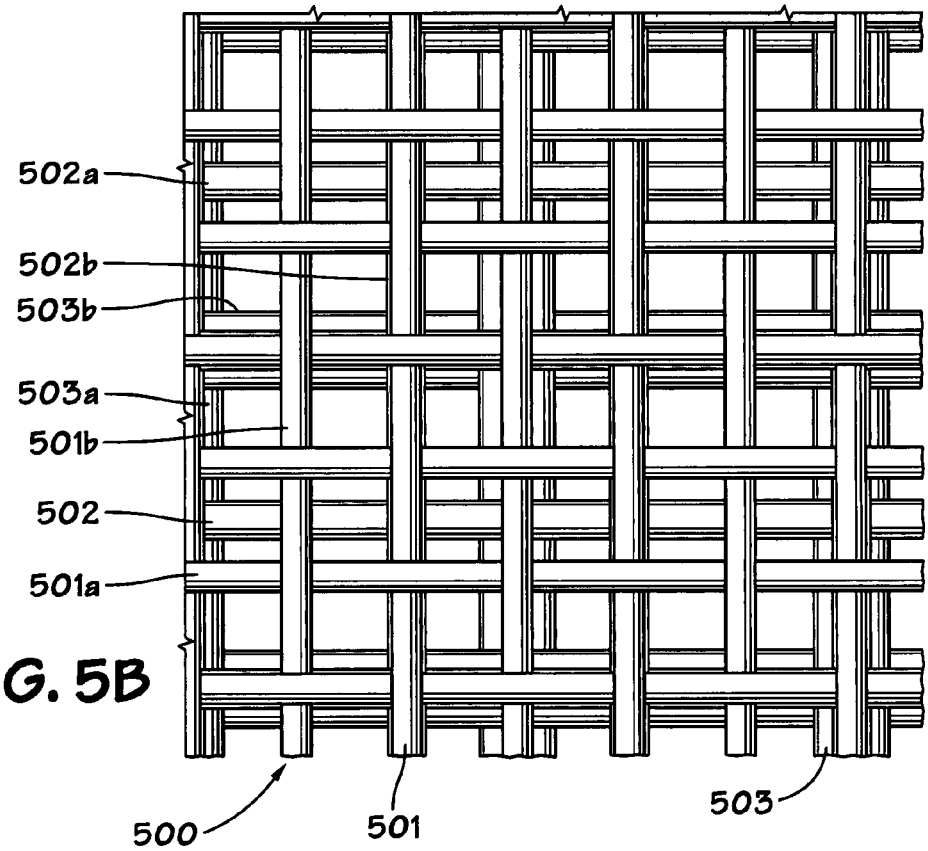
FIG. 5B
FIG. 5F
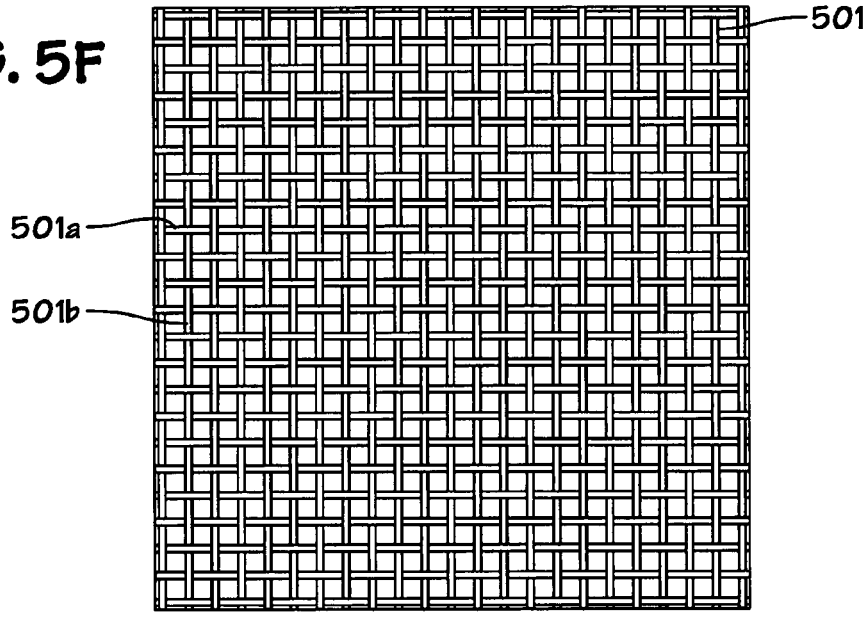
FIG. 5G
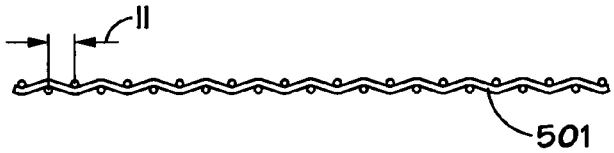

FIG. 5H
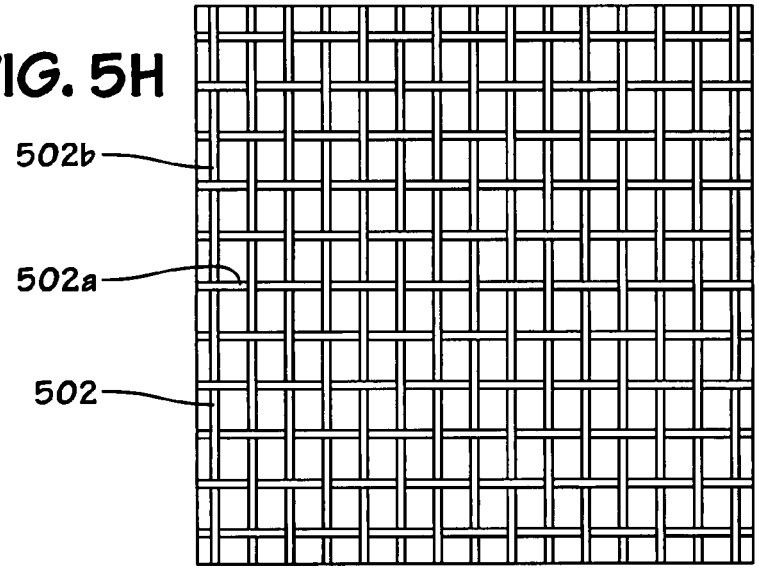
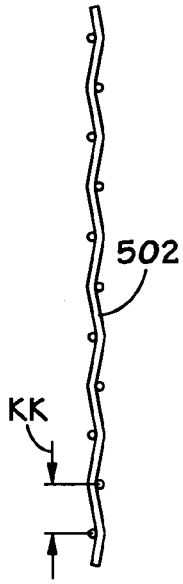
FIG. 5J
FIG. 5I
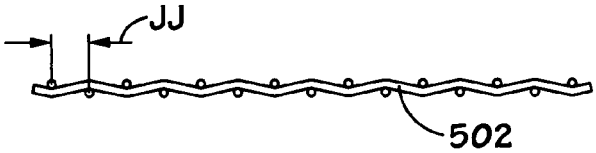
FIG. 5K
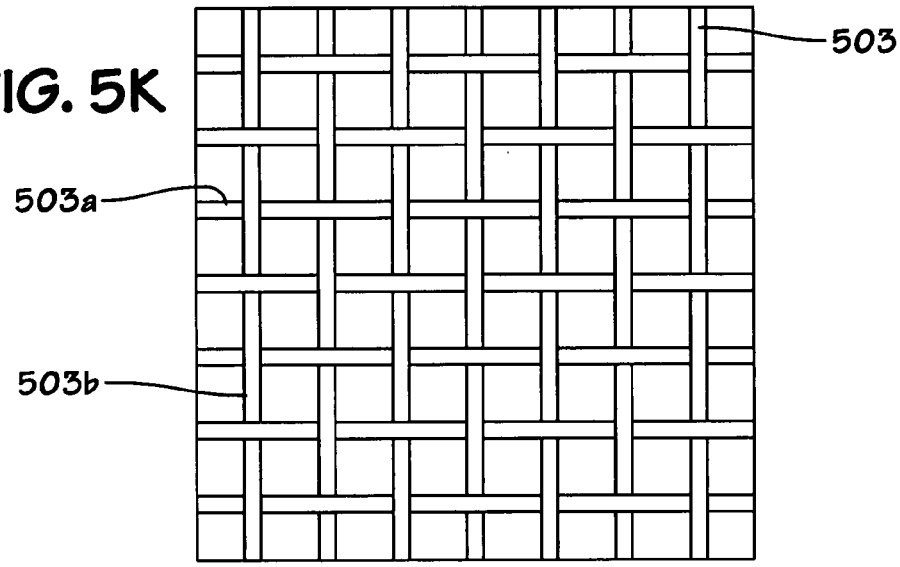
FIG. 5L
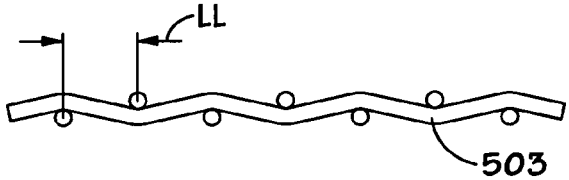

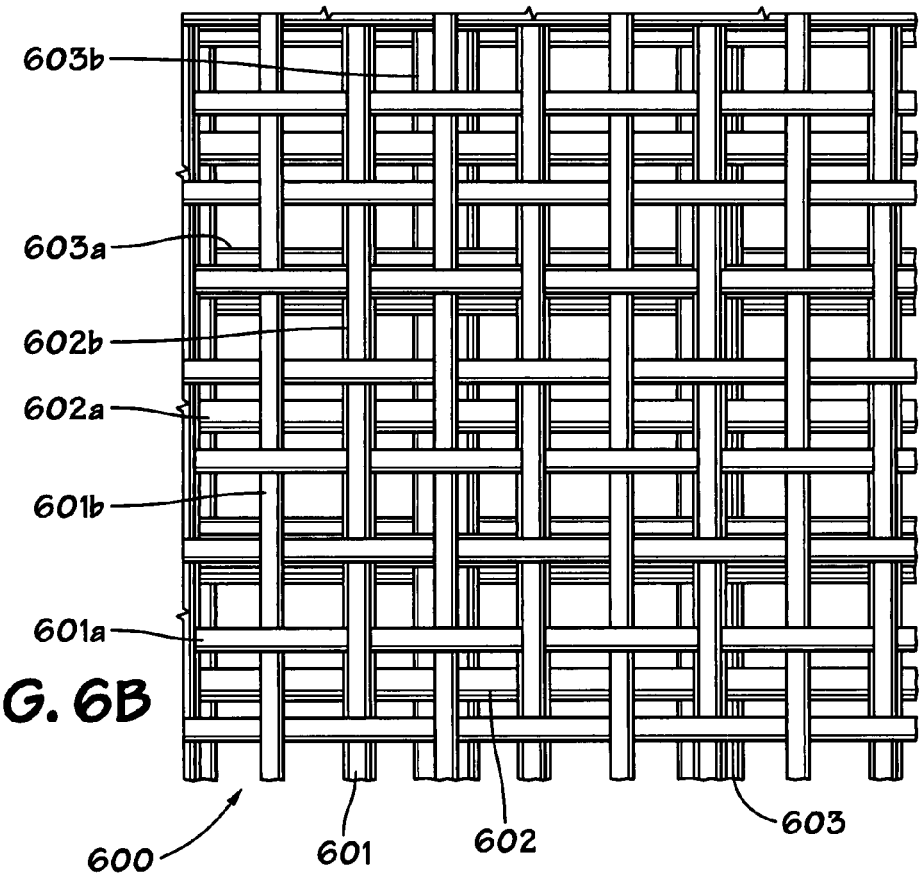
FIG. 6B
FIG. 6F
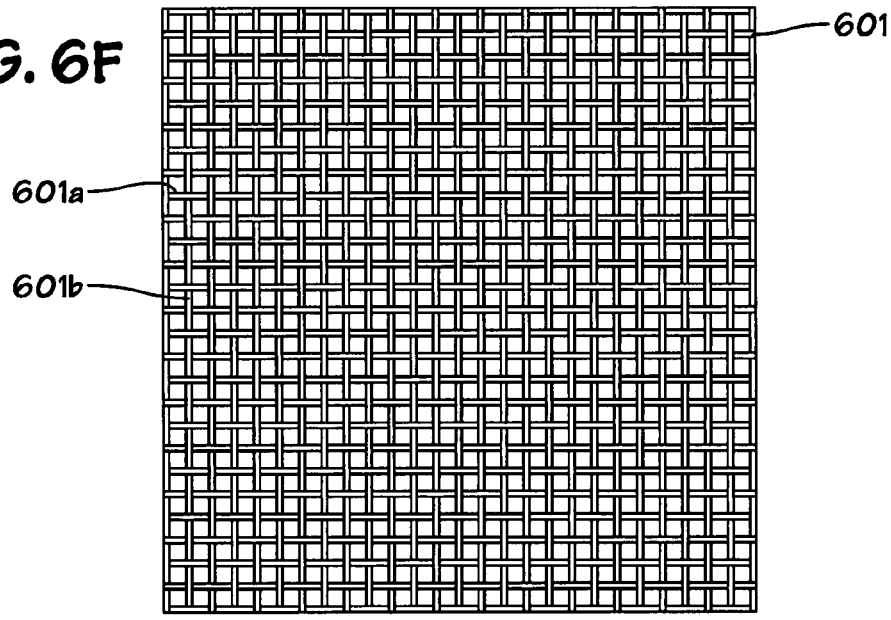
FIG. 6G
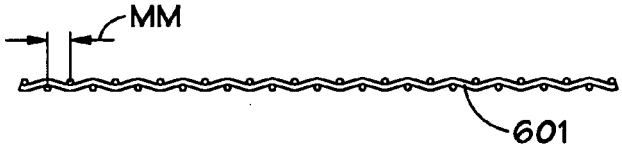

FIG. 6H
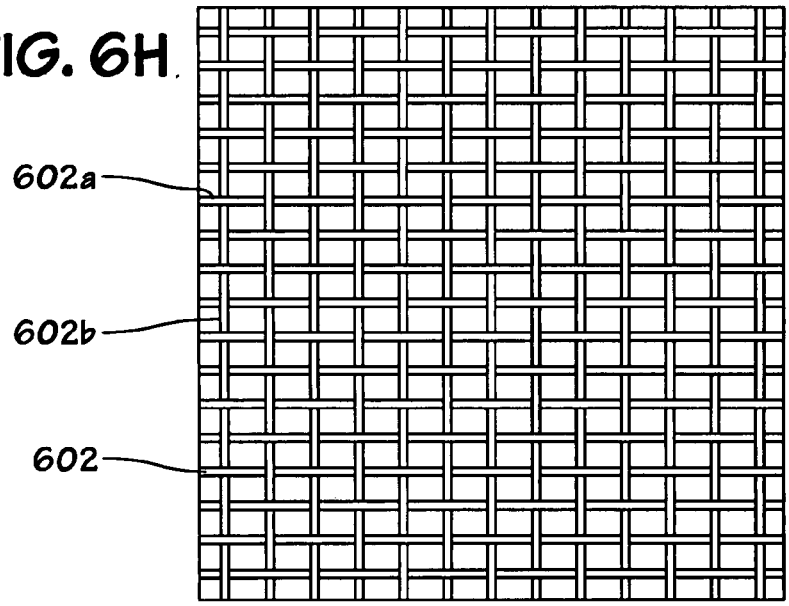
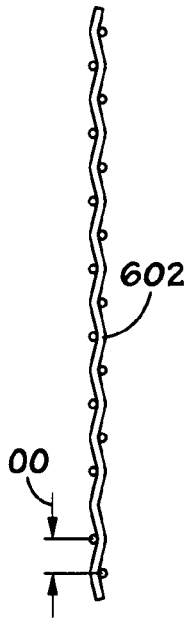
FIG. 6J
FIG. 6I
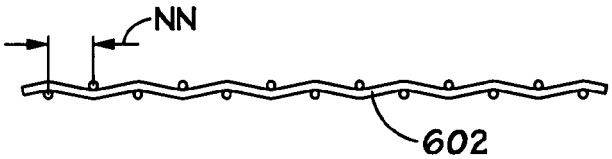
FIG. 6K
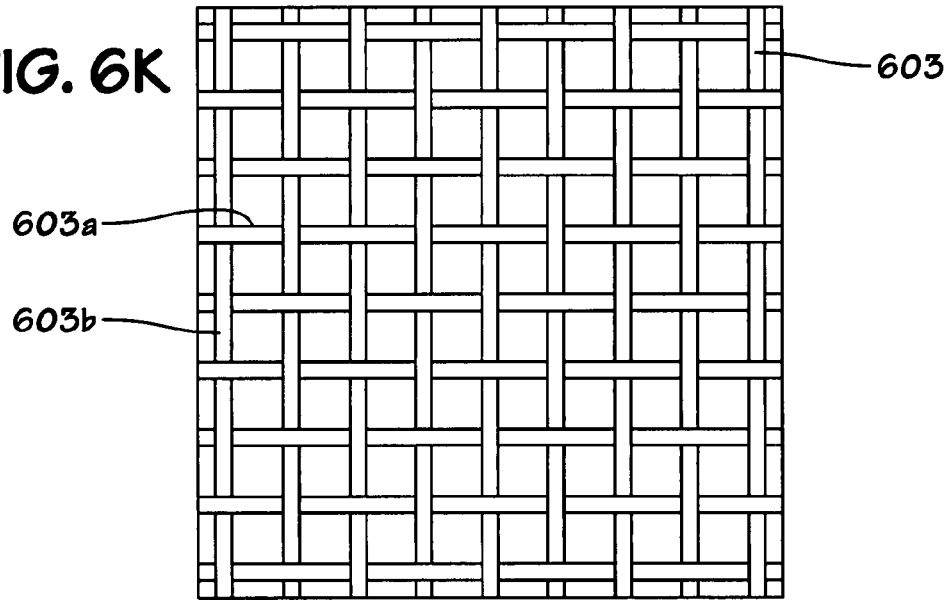
FIG. 6L
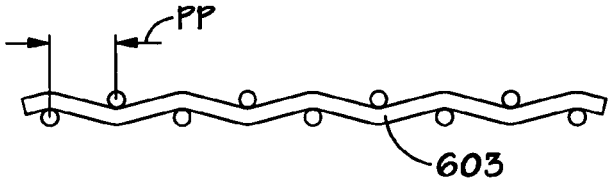

FIG. 8

| Range | | | | Description |
|---|---|---|---|---|
| 25 | to | 500 | 1 | Top Warp Openings in Microns |
| 0.1 | to | 1.1 | 2 | Wire Diameter Multiplier |
| | | | | 2a: Limitation on Fine End |
| | | | 3 | Top Cloth Specification |
| 0.25 | to | 4.00 | | 3a: Aspect Ratio: |
| 5 | to | 45 | | 3b: Top Warp Theoretical Angle (degrees) |
| 0.1 | to | 10 | 4 | Top Warp to Middle Warp COUNT Ratios |
| 1 | to | 10 | | 4a: The numerator in the Top Warp to Middle Warp COUNT Ratio is an integer |
| 1 | to | 10 | | 4b: The denominator in the Top Warp to Middle Warp COUNT Ratio is an integer |
| 0.1 | to | 10 | 5 | Top Shute to Middle Shute COUNT Ratio |
| 1 | to | 10 | | 5a: The numerator in the Top Warp to Middle Shute COUNT Ratio is an integer |
| 1 | to | 10 | | 5b: The denominator in the Top Warp to Middle Shute COUNT Ratio is an integer |
| | | | 6 | Top to Middle Wire Diameter Ratio: |
| 0.2 | to | 5 | | 6a: Constant Ratio for all cloth |
| | | | | 6b: Ratio Calculated |
| 0.1 | to | 10 | 7 | Middle to Bottom Warp COUNT Ratio |
| 1 | to | 10 | | 7a: The numerator in the Middle Warp to Bottom Warp COUNT Ratio is an integer |
| 1 | to | 10 | | 7b: The denominator in the Middle Warp to Bottom Warp COUNT Ratio is an integer |
| 0.1 | to | 10 | 8 | Middle to Bottom Shute COUNT Ratio |
| 1 | to | 10 | | 8a: The numerator in the Middle Warp to Bottom Shute COUNT Ratio is an integer |
| 1 | to | 10 | | 8b: The denominator in the Middle Warp to Bottom Shute COUNT Ratio is an integer |
| | | | 9 | Middle to Bottom Wire Diameter Ratio |
| 0.2 | to | 5 | | 9a: Constant Ratio for all cloth |
| | | | | 9b: Ratio Calculated |

FIG. 8A

| Screen | Top Warp Opening in Microns | Wire Diameter Multiplier | Top Aspect Ratio | Warp: Top to Middle COUNT Ratios | Shute: Top to Middle COUNT Ratios | TMDR Value | Warp: Middle to Bottom COUNT Ratios | Shute: Middle to Bottom COUNT Ratios | MBDR Value |
|---|---|---|---|---|---|---|---|---|---|
| 1 | 195.301 | 0.4292 | 1.0000 | 1.4918 | 2.5278 | 0.7021 | 2.0333 | 1.2000 | 0.6267 |
| 2 | 165.329 | 0.3841 | 1.0000 | 1.5000 | 2.5227 | 0.6944 | 2.4667 | 1.4667 | 0.4800 |
| 3 | 137.637 | 0.3875 | 1.0000 | 1.4944 | 2.5094 | 0.7000 | 2.9667 | 1.7667 | 0.4000 |
| 4 | 115.039 | 0.3974 | 1.0000 | 1.5048 | 2.5079 | 0.6923 | 3.5000 | 2.1000 | 0.3467 |
| 5 | 97.729 | 0.3899 | 1.0000 | 1.4960 | 2.4933 | 0.7143 | 4.1667 | 2.5000 | 0.2800 |
| 6 | 79.869 | 0.4134 | 1.0000 | 1.5000 | 2.5000 | 0.6842 | 5.0000 | 3.0000 | 0.2533 |

FIG. 8B

| Screen | Top Warp Count | Top Shute Count | Top Diameter (Inches) | Middle Warp Count | Middle Shute Count | Middle Diameter (Inches) | Bottom Warp Count | Bottom Shute Count | Bottom Diameter (Inches) |
|---|---|---|---|---|---|---|---|---|---|
| 1 | 91.0 | 91.0 | 0.0033 | 61.0 | 36.0 | 0.0047 | 30.0 | 30.0 | 0.0075 |
| 2 | 111.0 | 111.0 | 0.0025 | 74.0 | 44.0 | 0.0036 | 30.0 | 30.0 | 0.0075 |
| 3 | 133.0 | 133.0 | 0.0021 | 89.0 | 53.0 | 0.0030 | 30.0 | 30.0 | 0.0075 |
| 4 | 158.0 | 158.0 | 0.0018 | 105.0 | 63.0 | 0.0026 | 30.0 | 30.0 | 0.0075 |
| 5 | 187.0 | 187.0 | 0.0015 | 125.0 | 75.0 | 0.0021 | 30.0 | 30.0 | 0.0075 |
| 6 | 225.0 | 225.0 | 0.0013 | 150.0 | 90.0 | 0.0019 | 30.0 | 30.0 | 0.0075 |

1000d (FEED END)
1000a (SIDES)
1000e (DISCHARGE END)
1006

1000e
1000b
1000d 1000e
1004
1000

1000a
1002
1004
1000d

VIBRATORY SEPARATORS AND SCREENS

BACKGROUND OF THE INVENTION

1. Field of the Invention

The present invention is directed to screens for shale shakers and vibratory separators, and, in certain particular aspects, to screens with aligned wires.

2. Description of Related Art

Vibratory separators are used in a wide variety of industries to separate materials such as liquids from solids or solids from solids. In the oil and gas industries, shale shakers use screens to treat drilling fluid contaminated with undesirable solids. Typically such apparatuses have a basket, deck, or other screen holding or mounting structure mounted in or over a receiving receptacle or tank and vibrating apparatus for vibrating one or more screens. Material to be treated is introduced to the screen(s) either by flowing it directly onto the screen(s) or by flowing it into a container, tank, or "possum belly" from which it then flows to the screen(s).

In a variety of prior art screens, screen mesh or screen cloth as manufactured has a plurality of initially substantially square or rectangular openings defined by intersecting wires of the screen; i.e., as made a first plurality of substantially parallel wires extending in one general direction are perpendicular to a second plurality of substantially parallel wires, all the wires defining square or rectangular openings. In placing one such screen mesh or cloth on top of another, it can happen accidentally that wires of one layer are aligned with wires of another layer; but no effort is made to insure that a large portion, a majority, or substantially all wires of one layer are aligned with wires of another layer. In many actual uses, misalignment of wires occurs, resulting in the deformation of desired openings between wires and, therefore, in reduced screen effectiveness, reduced efficiency, and premature screen failure.

There has long been a need, recognized by the present inventors, for effective screens for shakers and separators. There has long been a need, recognized by the present inventors, for such screens with a substantial portion of aligned wires.

BRIEF SUMMARY OF THE INVENTION

The present invention discloses, in certain aspects, screening assemblies for shale shakers or other vibratory separators which have a plurality of screen wires in each of multiple screen mesh and/or screen cloth layers which are substantially aligned—wires in one layer aligned with wires in another layer according to preselected parameters. In certain aspects wires in such screening assemblies remain aligned during use. The present invention discloses, in certain aspects, a screen for a vibratory separator, or shale shaker, having at least two layers of screening material; the at least two layers of screening material including a first layer and a second layer, the first layer made of a plurality of intersecting first wires, the second layer made of a plurality of intersecting second wires, the first layer above the second layer; the first wires including first shute wires and first warp wires, each of the first shute wires at an angle to first warp wires; the second wires including second shute wires and second warp wires, each of the second shute wires at an angle to second warp wires; each of a plurality of the first warp wires aligned with a corresponding second warp wire according to a preselected wire count ratio, and each of a plurality of the first shute wires aligned with a corresponding second shute wire according to a preselected wire count ratio.

In certain particular aspects, wire alignment in such screen assemblies with multiple screening layers is facilitated by using screen meshes or cloths with a selected number of wires per inch in each layer, particularly with a ratio of number of wires in adjacent layers which is a ratio of two numbers which are either exact integers or are almost exact integers; e.g., in certain aspects, within ±0.1 of an integer.

In other aspects of screen assemblies according to the present invention, wires are aligned either one on top of the other vertically or wires are aligned in a line at an angle to the horizontal plane of a screen assembly; and, in one particular aspect, wires in multiple screen layers are aligned along a line which is coincident with a force vector imparted to the screen assembly by vibrating apparatus of the shaker or separator.

In certain particular aspects, in methods for making a multi-layer screen according to the present invention, multiple layers are carefully stacked together so that wires in different layers are aligned and then, optionally, the layers are connected together (welded, glued, epoxied, adhered, sintered, etc.) to maintain this alignment in subsequent manufacturing steps.

A vibratory separator or shale shaker, in one embodiment according to the present invention is, according to the present invention, provided with one, two, three or more screens as described herein according to the present invention. The present invention, in certain embodiments, includes a vibratory separator or shale shaker with a base or frame; a "basket" or screen mounting apparatus on or in the base or frame; one, two, three or more screens according to the present invention with wires aligned according to the present invention; vibrating apparatus; and a collection tank or receptacle. In one particular aspect, such a shale shaker treats drilling fluid contaminated with solids, e.g. cuttings, debris, etc.

Accordingly, the present invention includes features and advantages which are believed to enable it to advance vibrated screen technology. Characteristics and advantages of the present invention described above and additional features and benefits will be readily apparent to those skilled in the art upon consideration of the following detailed description of preferred embodiments and referring to the accompanying drawings.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, nonobvious screens for vibratory separators and shale shakers and methods for using them to separate components of material to be treated thereby; in one aspect, systems for shale shakers for treating drilling fluid with solids therein; and Such separators and shakers with one, two, three or more useful, unique, efficient, and nonobvious screens according to the present invention with wires in one screen layer aligned with wires in another screen layer.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 3H is a top view of a middle layer of the screen of FIG. 3A.

FIG. 3I is an end cross-section view of the layer of FIG. 3H.

FIG. 3J is a side cross-section view of the layer of FIG. 3H.

FIG. 3K is a top view of a bottom layer of the screen of FIG. 3A.

FIG. 3L is an end cross-section view of the layer of FIG. 3K.

FIG. 4H is a top view of a middle layer of the screen of FIG. 4A.

FIG. 4I is an end cross-section view of the layer of FIG. 4H.

FIG. 4J is a side cross-section view of the layer of FIG. 4H.

FIG. 4K is a top view of a bottom layer of the screen of FIG. 4A.

FIG. 4L is an end cross-section view of the layer of FIG. 4K.

FIG. 5A is a top view of a screen according to the present invention.

FIG. 5B is an enlarged top view of part of the screen of FIG. 5A.

FIG. 5C is an enlarged top view of the center of the screen of FIG. 5A.

FIG. 5D is a cross-section view along line 5D-5D of FIG. 5A.

FIG. 5E is a cross-section view along line 5E-5E of FIG. 5A.

FIG. 5F is a top view of a top layer of the screen of FIG. 5A.

FIG. 5G is an end cross-section view of the layer of FIG. 5F.

FIG. 5H is a top view of a middle layer of the screen of FIG. 5A.

FIG. 5I is an end cross-section view of the layer of FIG. 5H.

FIG. 5J is a side cross-section view of the layer of FIG. 5H.

FIG. 5K is a top view of a bottom layer of the screen of FIG. 5A.

FIG. 5L is an end cross-section view of the layer of FIG. 5K.

FIG. 6B is an enlarged top view of part of the screen of FIG. 6A.

FIG. 6F is a top view of a top layer of the screen of FIG. 6A.

FIG. 6G is an end cross-section view of the layer of FIG. 6F.

FIG. 6H is a top view of a middle layer of the screen of FIG. 6A.

FIG. 6I is an end cross-section view of the layer of FIG. 6H.

FIG. 6J is a side cross-section view of the layer of FIG. 6H.

FIG. 6K is a top view of a bottom layer of the screen of FIG. 6A.

FIG. 6L is an end cross-section view of the layer of FIG. 6K.

FIG. 8 illustrates steps in a method according to the present invention.

FIG. 8A is a chart with information regarding certain screens according to the present invention.

FIG. 8B is a chart with additional information regarding the screens of FIG. 8A.

Figure 1A:
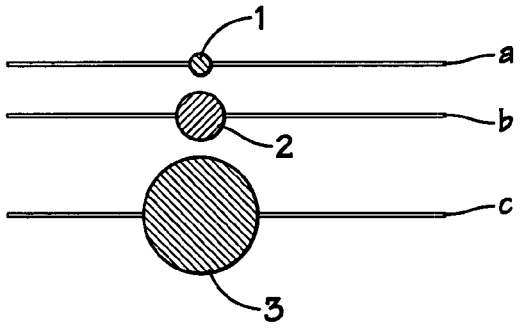
FIG. 1A is a schematic side cross-section view of a screen (shown partially) according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

Figure 1B:
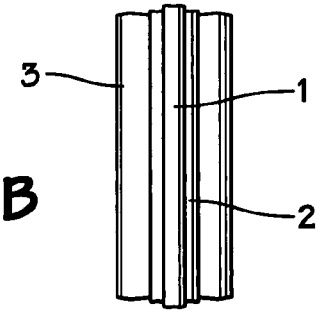
FIG. 1B is a top view of the screen of FIG. 1A showing three wires therein.

FIGS. 1A-2D illustrate the definition of "aligned wires." As shown in FIGS. 1A and 1B, wires 1, 2, 3 in multiple screening material layers a, b, c, respectively are aligned with each other vertically. As viewed from above (FIG. 1B) the wires 1, 2, 3 are in line vertically (at a ninety degree angle to the planes of the screen layers) and, as shown in FIG. 1B, parallel to each other.

Figure 1C:
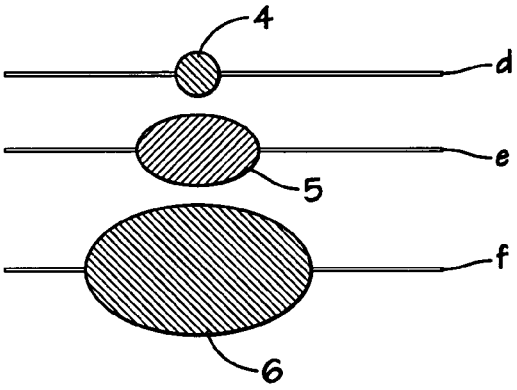
FIG. 1C is a schematic side cross-section view of a screen (shown partially) according to the present invention.

It is within the scope of the present invention to provide a screen assembly with a layer or layers of screen cloth in which wires have a non-round cross-section (whether such a layer is used in a screen or screen assembly without wires aligned or with wires aligned according to the present invention). FIG. 1C shows part of a screen assembly according to the present invention with screen cloth layers d, e, f with aligned wires 4, 5, 6, respectively. Wires 5 and 6 have non-round (oval) cross-sections.

Figure 1D:
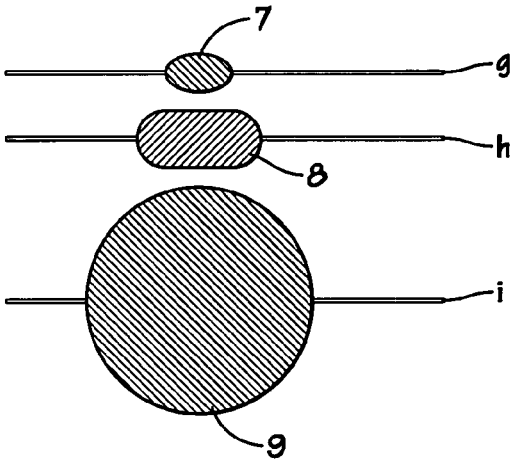
FIG. 1D is a schematic side cross-section view of a screen (shown partially) according to the present invention.

FIG. 1D shows a portion of a screen according to the present invention with screen cloth layers g, h, i with aligned wires 7, 8, 9, respectively. Wires 7 (oval) and 8 (rectangle with rounded corners) have non-round cross-sections.

Figure 2A:
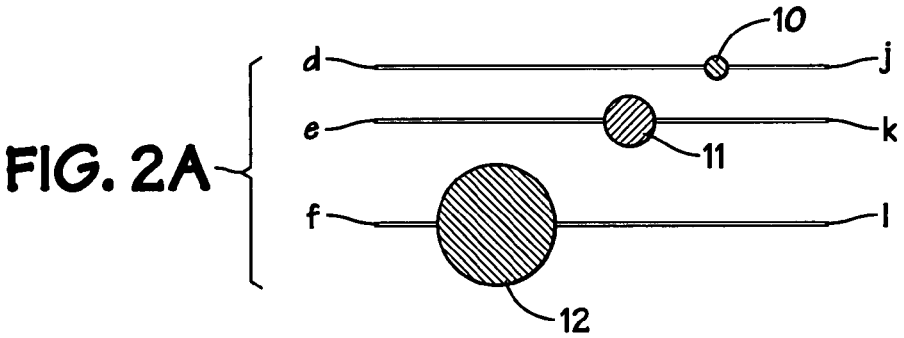
FIG. 2A is a schematic side cross-section view of a screen (shown partially) according to the present invention.
Figure 2B:
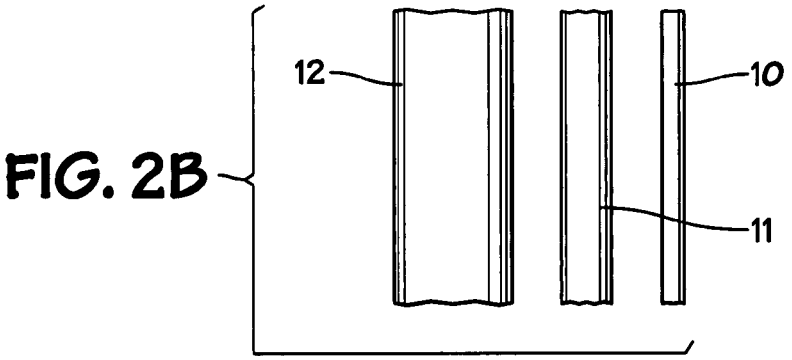
FIG. 2B is a top view of the screen of FIG. 2A showing three wires therein.

As shown in FIGS. 2A and 2B the wires 10, 11, 12 of screening material layers d, e, f, respectively are aligned with each other on a line that is at an angle to the plane of the screen layers (the plane of a screen assembly with such layers; e.g. as shown at an angle at about 45 degrees to the screen assembly plane). As viewed along this line the three wires 10, 11, 12 would appear as in the view of the wires 1, 2, 3 in FIG. 1B. It is desirable that the wires (e.g., 1, 2, 3 or 10, 11, 12) are parallel along their entire lengths.

Figure 2C:
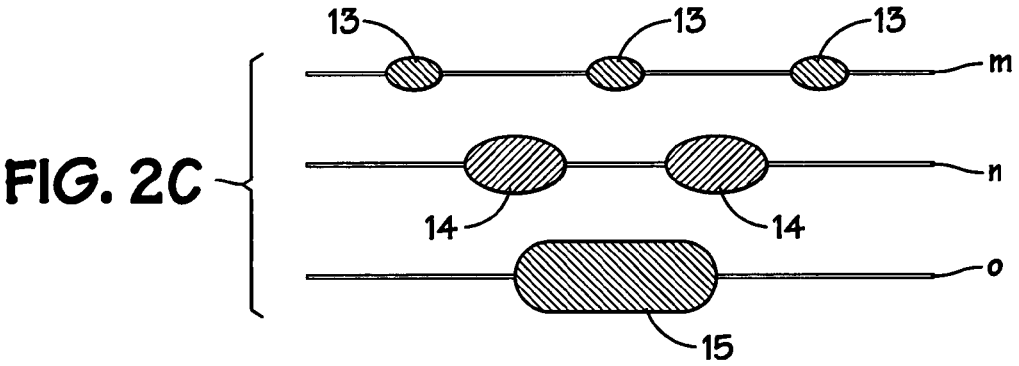
FIG. 2C is a schematic view of a screen (shown partially) according to the present invention.

FIG. 2C shows a screen with layers m, n, o with aligned wires 13 (oval), 14 (oval), and 15 (rectangle with rounded corners), respectively, with non-round cross-sections.

Figure 2D:
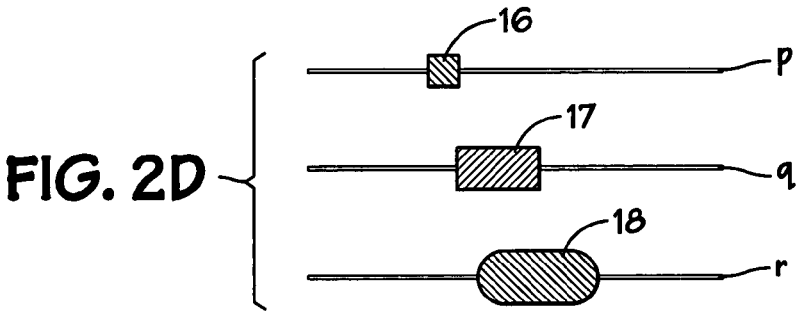
FIG. 2D is a schematic view of a screen (shown partially) according to the present invention.

FIG. 2D shows a screen with layers p, q, r with aligned wires 16 (square), 17 (rectangular) and 18 (rectangle with rounded corners), respectively with non-round cross-sections.

FIGS. 1A-2D are illustrative and are meant to show how wires in a particular screen or screen assembly are in alignment, or substantially all the wires are aligned, or the majority of wires in the entire screen layers depicted are aligned.

Figure 1E:
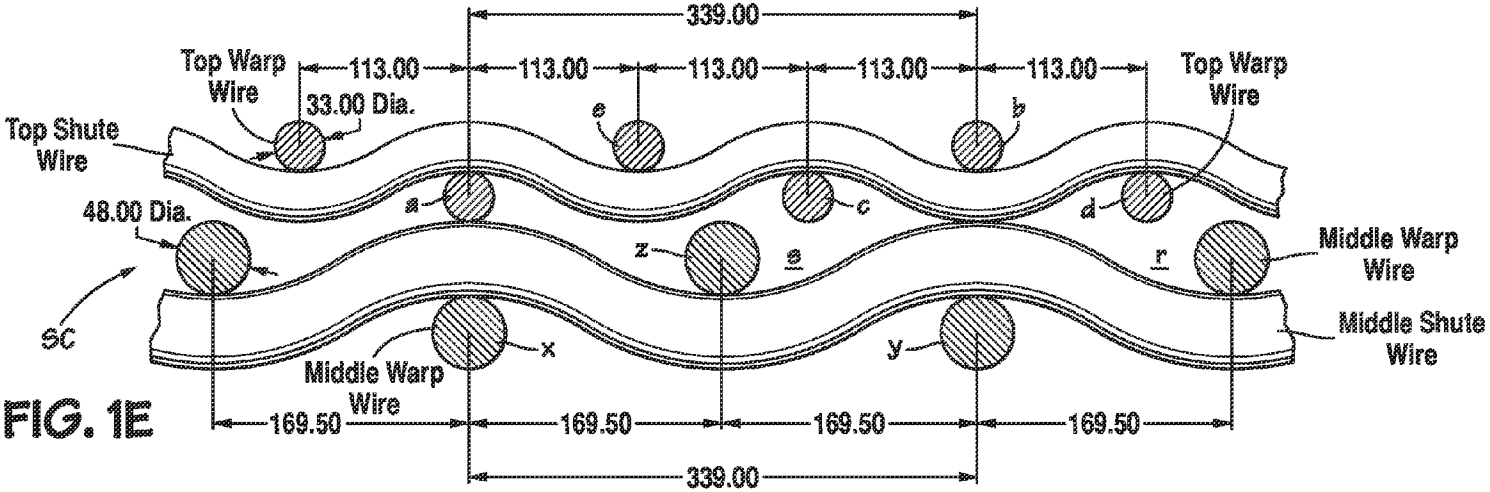
FIG. 1E is a cross-section view of a screen according to the present invention.
Figure 1F:
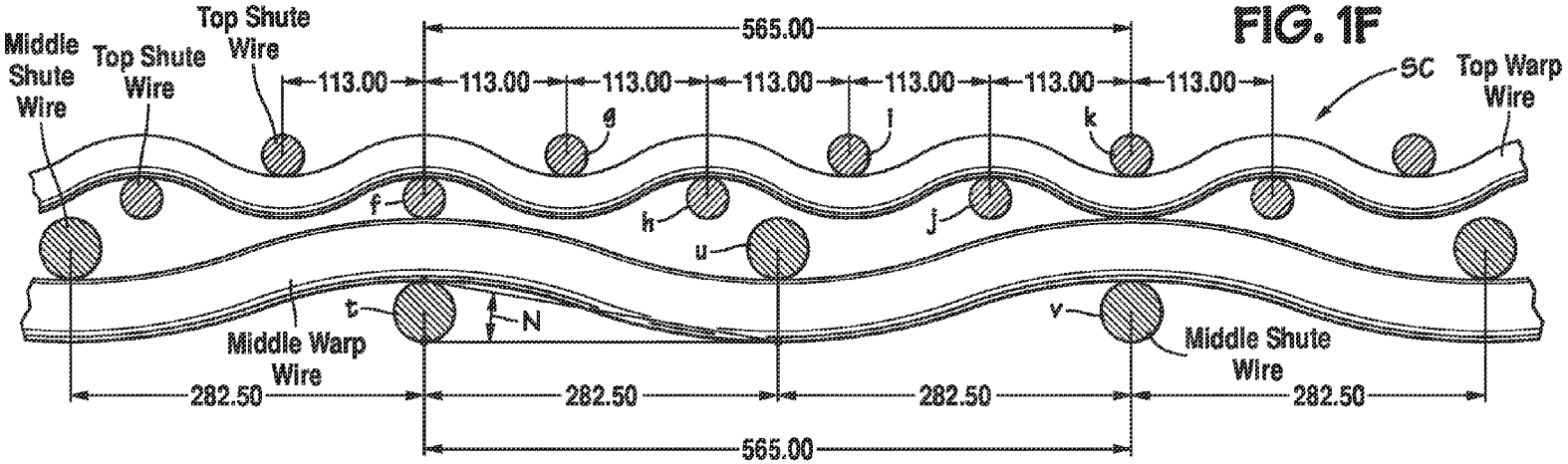
FIG. 1F is a cross-section view of the screen of FIG. 1E at an angle to the view of FIG. 1E.

FIGS. 1E and 1F illustrate two layers of screening material of a screen SC according to the present invention with aligned wires. In FIG. 1E the shute wires of both layers extend left-to-right and the warp wires, shown as circles, go into/out of the page. In FIG. 1F, the warp wires are shown as extending left-to-right and the shute wires, shown as circles, go into/out of the page. A weaving angle for the top layer is 16.3 degrees; a weaving angle for the bottom layer is 9.7 degrees. Angle N in FIG. 1F illustrates a weaving angle.

For the specific layers shown in FIGS. 1E and 1F, the numerical measurements indicated are in microns, e.g. "113" indicates 113 microns.

As shown in FIG. 1E wires a and b of the top layer are perfectly aligned with wires x and y of the lower layer. Also, wire c of the top layer can move toward the lower layer into a space s adjacent a wire z of the lower layer and a wire d can nest in a space r. In effect, wires x "masks" wire a and wire y "masks" wire b so that the screen SC has relatively more open areas than if the wires a and b were offset from the wires x, y, (respectively).

A ratio of wires spanning 339 microns of the screen SC as viewed in FIG. 1E (ratio of top warp wires to lower warp wires) is 3:2 (one half wire a plus wire e plus wire c plus one half wire b—or three wires—above two wires, one half wire x, plus wire y, plus one half wire z—or two wires). As shown in FIG. 1E, which has a wire count ratio of 3:2 for the top and middle warp wires, then, perfect alignment occurs if every third warp wire on the top layer aligns with every second warp wire of the layer below (as is shown in FIG. 1E)—i.e., two out of five wires are aligned or 40% alignment is achieved in one direction. In certain aspects of embodiments of the present invention, wires in one layer are aligned with wires in another layer according to the chosen wire count ratio (chosen according to the present invention). Thus with a top to middle wire count ratio of 5:2 in one direction, e.g., for the top and middle warp wires, every fifth warp wire of the top layer aligns with every second warp wire of the layer below—i.e., two out of seven wires are aligned or alignment of 28.5% is achieved in one direction. Thus, according to the present invention, wires are "aligned" when wire count ratios are as selected according to the present invention.

A ratio of wires spanning 565 microns of the screen SC as viewed in FIG. 1F (ratio of top shute wires to lower shute wires) is 5:2. (The top layer has square openings; the lower layer has rectangular openings.)

As shown in FIG. 1F wires f and k of the top layer are perfectly aligned with wires t and v of the lower layer.

Figure 3A:
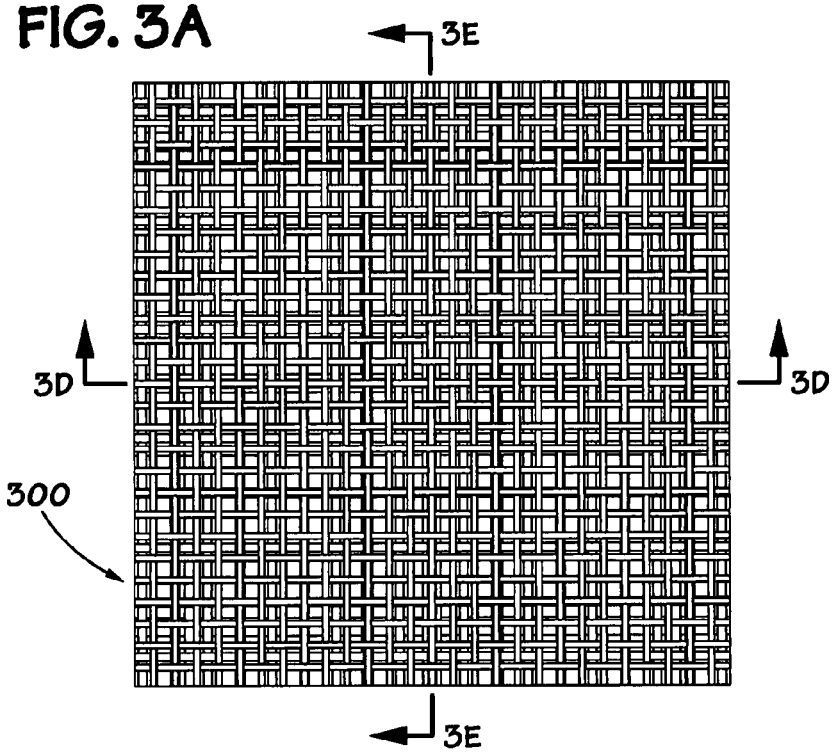
FIG. 3A is a top view of a screen according to the present invention.
Figure 3C:
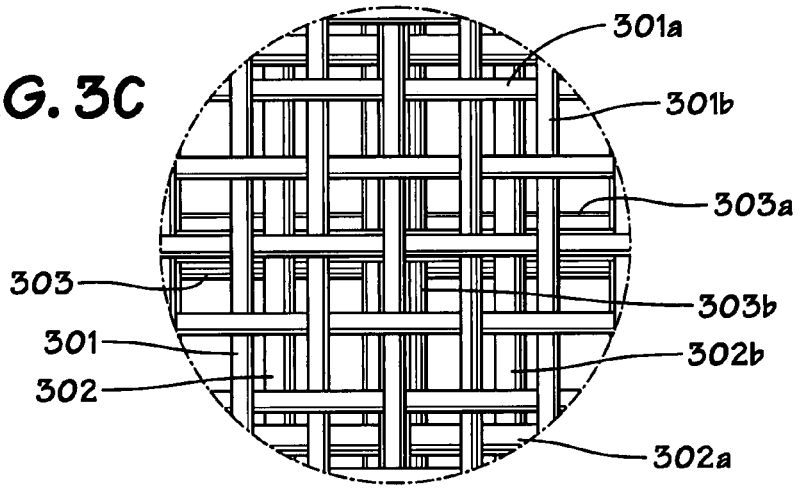
FIG. 3C is an enlarged top view of the center of the screen of FIG. 3A.
Figure 3D:
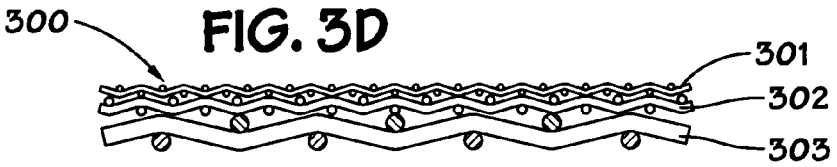
FIG. 3D is a cross-section view along line 3D-3D of FIG. 3A.
Figure 3E:
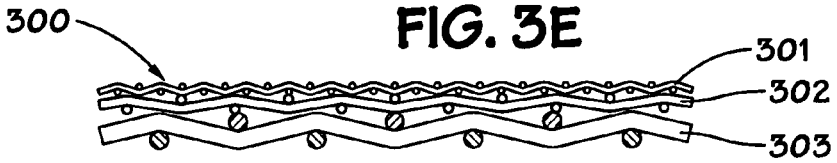
FIG. 3E is a cross-section view along line 3E-3E of FIG. 3A.
Figure 3B:
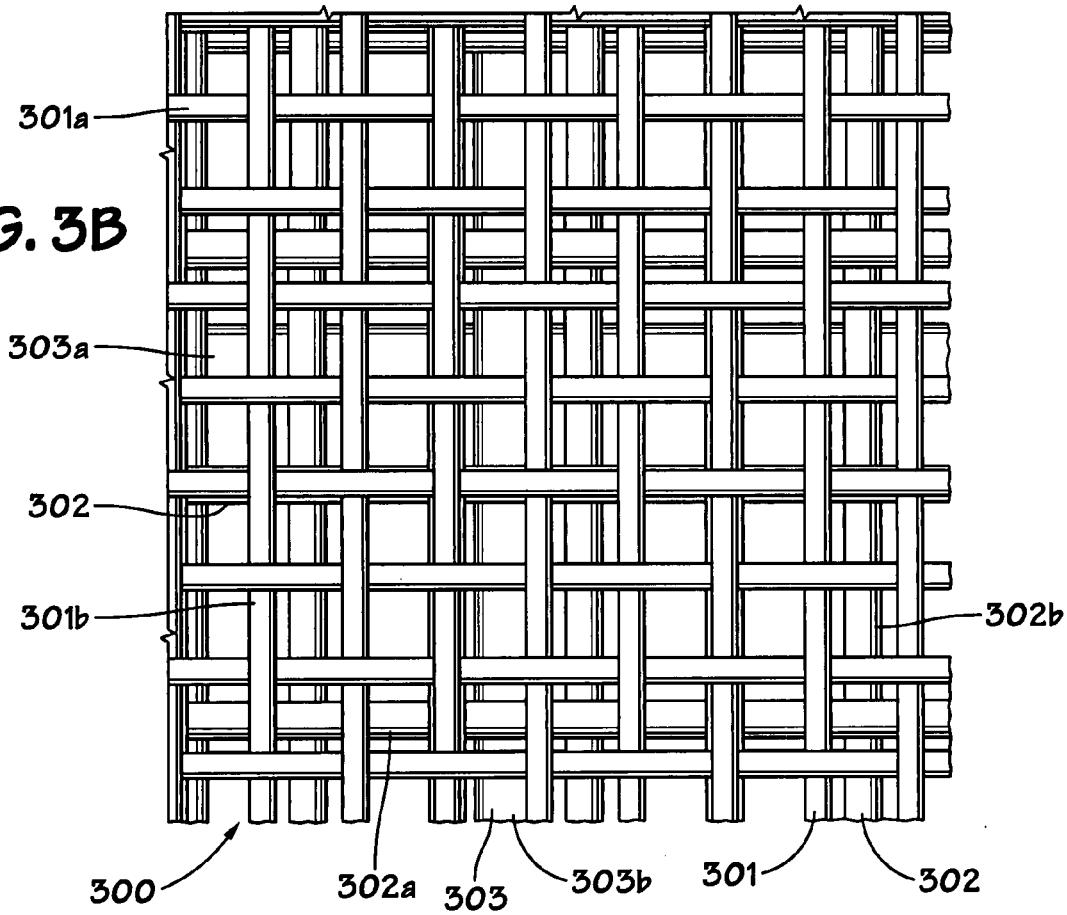
FIG. 3B is an enlarged top view of part of the screen of FIG. 3A.
Figure 3F:
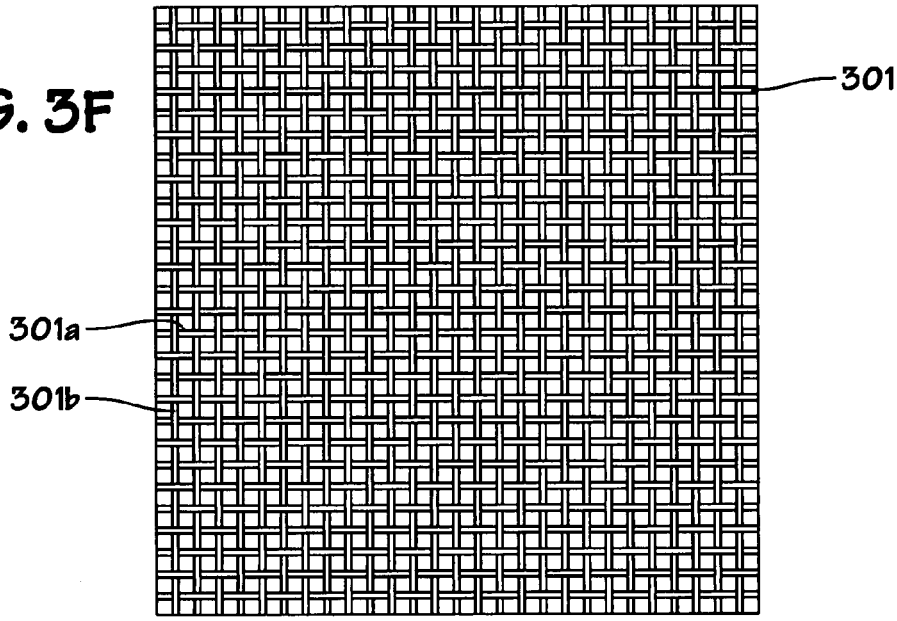
FIG. 3F is a top view of a top layer of the screen of FIG. 3A.
Figure 3G:
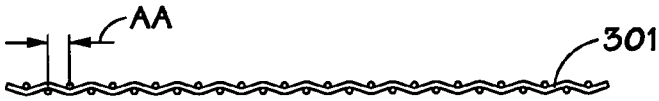
FIG. 3G is an end cross-section view of the layer of FIG. 3F.

FIGS. 3A-3L show a screen 300 according to the present invention and parts of it. The screen 300 has multiple mesh layers 301 (top), 302 (middle) and 303 (bottom). As shown in FIGS. 3B and 3C, the wires of each layer are aligned with the wires of the other two layers.

In one particular embodiment of a screen 300, the layer 301 has warp wires 301*a* and shute wires 301*b*; the layer 302 has warp wires 302*a* and shute wires 302*b*; and the layer 303 has warp wires 303*a* and shute wires 303*b*. The number of each of these types of wires per inch, wire diameters, and spacings AA, BB, CC, DD, as viewed from above, are as follows:

| | No./inch | Diameter (inches) | Spacing (inches) |
|---|---|---|---|
| 301a | 111 | .00250 | .0090 |
| 301b | 111 | .00250 | .0090 |
| 302a | 74 | .00360 | .0135 |
| 302b | 44 | .00360 | .0227 |
| 303a | 30 | .00750 | .0333 |
| 303b | 30 | .00750 | .0333 |

Figure 4A:
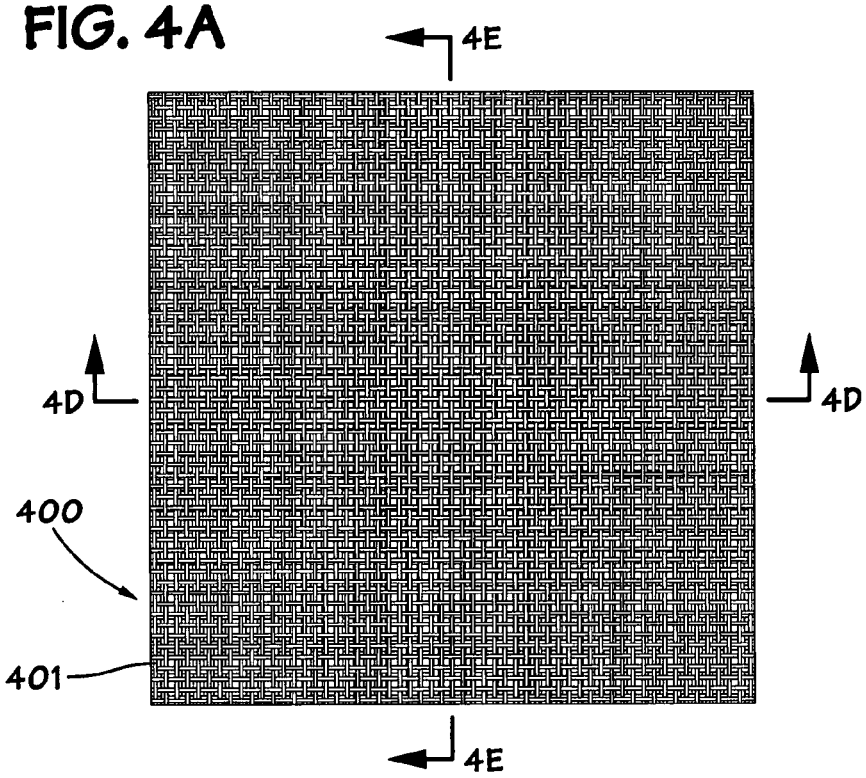
FIG. 4A is a top view of a screen according to the present invention.
Figure 4C:
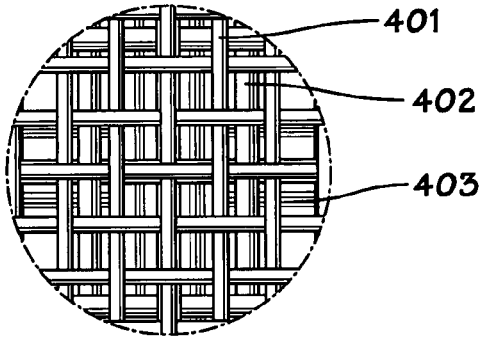
FIG. 4C is an enlarged top view of the center of the screen of FIG. 4A.
Figure 4D:
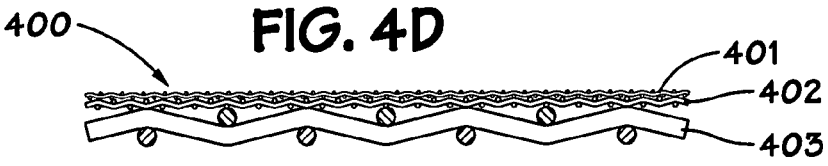
FIG. 4D is a cross-section view along line 4D-4D of FIG. 4A.
Figure 4E:
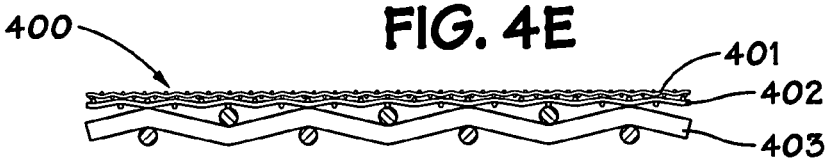
FIG. 4E is a cross-section view along line 4E-4E of FIG. 4A.
Figure 4B:
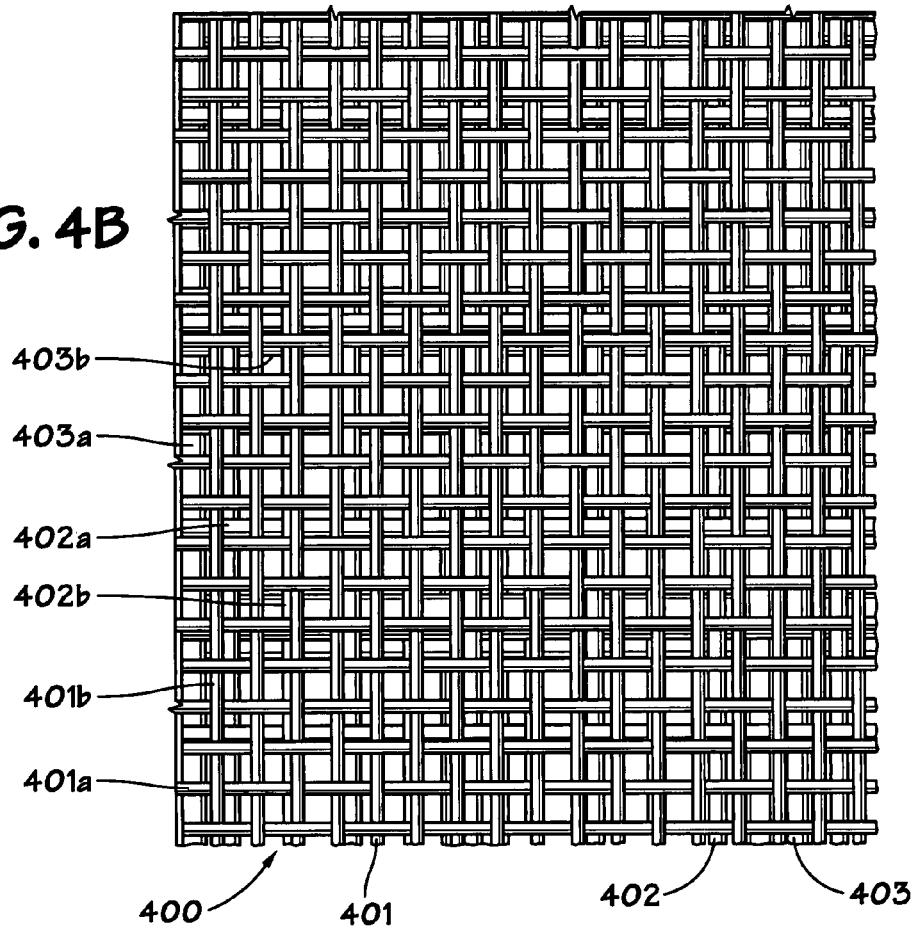
FIG. 4B is an enlarged top view of part of the screen of FIG. 4A.
Figure 4F:
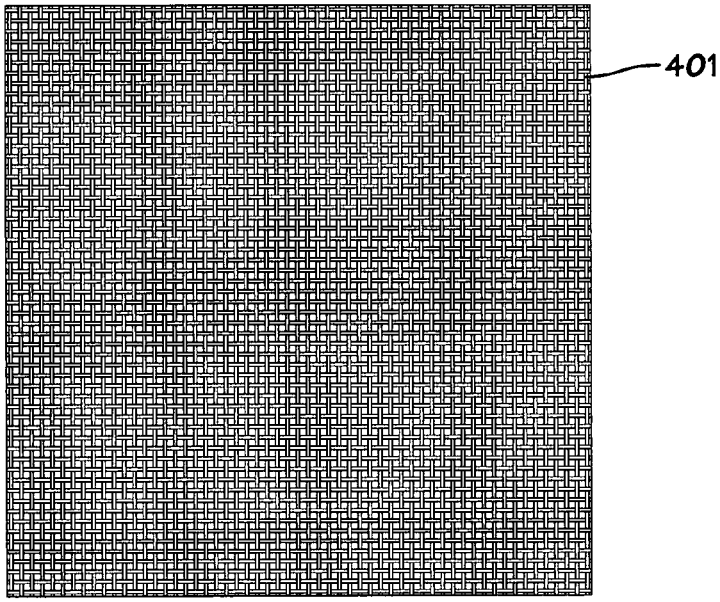
FIG. 4F is a top view of a top layer of the screen of FIG. 4A.
Figure 4G:
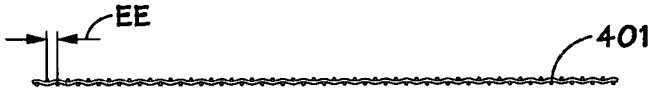
FIG. 4G is an end cross-section view of the layer of FIG. 4F.

FIGS. 4A-4L show a screen 400 according to the present invention and parts of it. The screen 400 has multiple mesh layers 401 (top), 402 (middle) and 403 (bottom). As shown in FIGS. 4B and 4C, the wires of each layer are aligned with the wires of the other two layers.

In one particular embodiment of a screen 400, the layer 401 has warp wires 401*a* and shute wires 401*b*; the layer 402 has warp wires 402*a* and shute wires 402*b*; and the layer 403 has warp wires 403*a* and shute wires 403*b* (warp wires across from left/right or right/left, FIG. 4B; shute wires intersect warp wires—as is also true for FIGS. 3B, 5B, and 6B). The number of each of these wires per inch, wire diameters, and the wire spacings EE, FF, GG, HH (as viewed from above) are as follows:

| | No./inch | Diameter (inches) | Spacing (inches) |
|---|---|---|---|
| 401a | 225 | .00130 | .0044 |
| 401b | 225 | .00130 | .0044 |
| 402a | 150 | .00190 | .0067 |
| 402b | 90 | .00190 | .0011 |
| 403a | 30 | .00750 | .0333 |
| 403b | 30 | .00750 | .0333 |

FIGS. 5A-5L show a screen 500 according to the present invention and parts of it. The screen 500 has multiple mesh layers 501 (top), 502 (middle) and 503 (bottom). As shown in FIGS. 5B and 5C, the wires of each layer are aligned with the wires of the other two layers.

In one particular embodiment of a screen 500, the layer 501 has warp wires 501*a* and shute wires 501*b*; the layer 502 has warp wires 502*a* and shute wires 502*b*; and the layer 503 has warp wires 503*a* and shute wires 503*b*. The number of each of these wires per inch, wire diameters, and the wire spacings II, JJ, KK, LL (as viewed from above) are as follows:

| | No./inch | Diameter (inches) | Spacing (inches) |
|---|---|---|---|
| 501a | 90 | .00300 | .0044 |
| 501b | 90 | .00300 | .0044 |
| 502a | 60 | .00370 | .0067 |
| 502b | 45 | .00370 | .0011 |
| 503a | 30 | .00750 | .0333 |
| 503b | 30 | .00750 | .0333 |

Figure 6A:
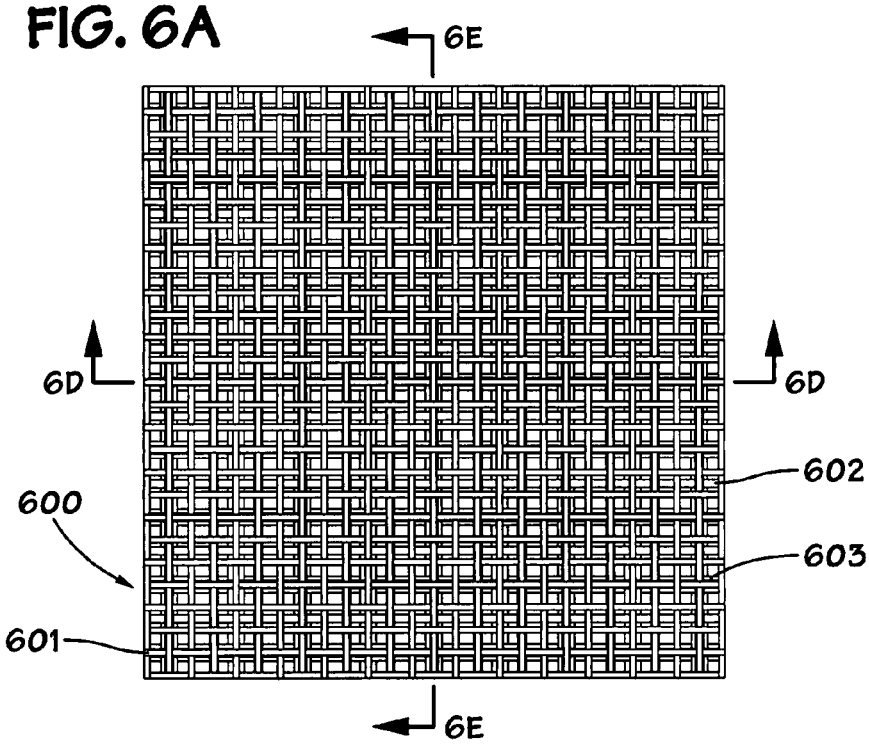
FIG. 6A is a top view of a screen according to the present invention.
Figure 6C:
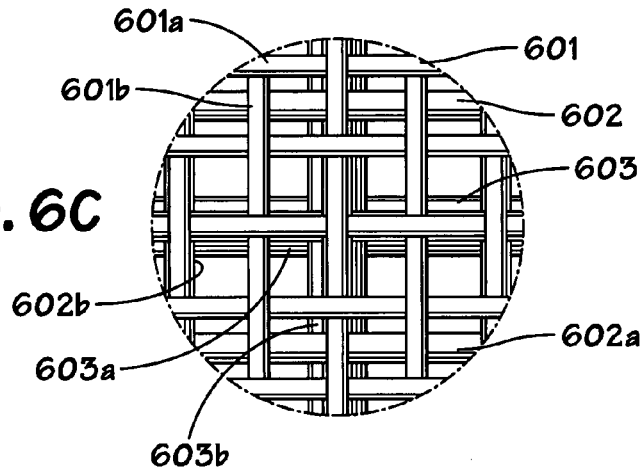
FIG. 6C is an enlarged top view of the center of the screen of FIG. 6A.
Figure 6D:
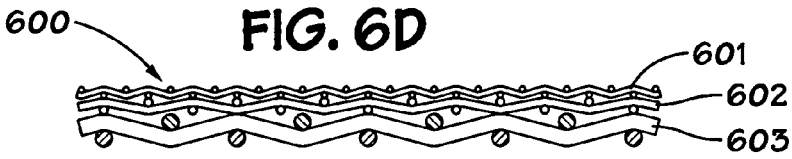
FIG. 6D is a cross-section view along line 6D-6D of FIG. 6A.
Figure 6E:
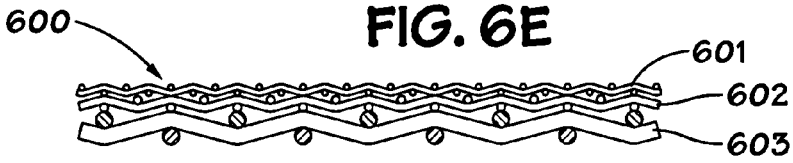
FIG. 6E is a cross-section view along line 6E-6E of FIG. 6A.

FIGS. 6A-6L show a screen 600 according to the present invention and parts of it. The screen 600 has multiple mesh layers 601 (top), 602 (middle) and 603 (bottom). As shown in FIGS. 6B and 6C, the wires of each layer are aligned with the wires of the other two layers.

In one particular embodiment of a screen 600, the layer 601 has warp wires 601*a* and shute wires 601*b*; the layer 602 has warp wires 602*a* and shute wires 602*b*; and the layer 603 has warp wires 603*a* and shute wires 603*b*. The number of each of these wires per inch, wire diameters, and the wire spacings MM, NN, OO, PP (as viewed from above) are as follows:

| | No./inch | Diameter (inches) | Spacing (inches) |
|---|---|---|---|
| 601a | 105 | .00250 | .0095 |
| 601b | 105 | .00250 | .0095 |
| 602a | 70 | .00350 | .0191 |
| 602b | 52.5 | .00350 | .0143 |
| 603a | 35 | .00700 | .0286 |
| 603b | 35 | .00700 | .0286 |

In certain aspects a screen according to the present invention (e.g., but not limited to, the screens of FIGS. 3A-7A) are made with multiple layers of screen cloth that are stacked one on top of the other. Ideally each piece of screen cloth as received from the manufacturer has well-defined openings between wires across its entire surface. According to the present invention, to insure that initially the wires of one layer line up with the wires of another layer and remain in this position during the making of a screen or screen assembly, two, three or more layers (however many are to be in the final screen or screen assembly), are carefully positioned one with respect to the other with wires aligned and then they are connected or secured together to hold them in position for further processing. In one aspect, the multiple layers are glued together with one or more amounts of hot melt glue or a line of hot melt glue is applied along one edge of the layers and allowed to set. Alternatively any suitable known glue, epoxy, adhesive or connector(s) (e.g. but not limited to staples, rivets, clips, etc.) may be used.

Figure 7A:
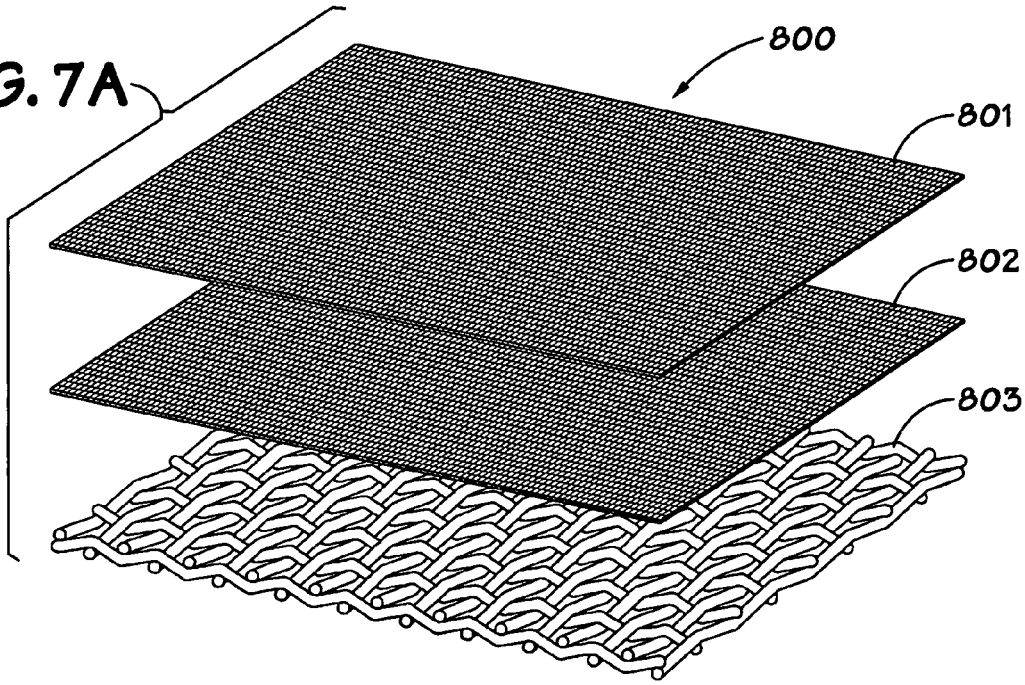
FIG. 7A is a perspective view of three layers of a screen according to the present invention.
Figure 7B:
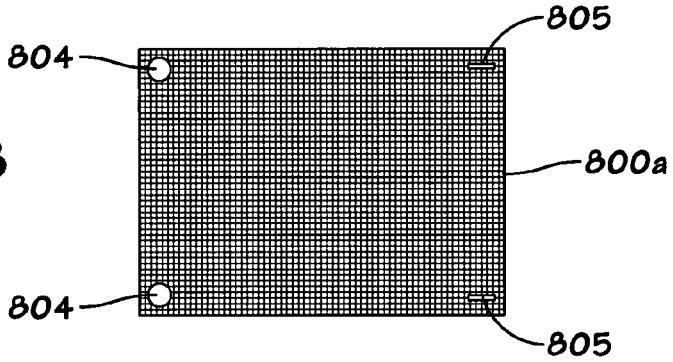
FIG. 7B is a top view of a screen according to the present invention made with the layers of FIG. 7A.

FIG. 7A shows a step in a method according to the present invention in which multiple layers of screen cloth 801, 802, 803 (three shown) are stacked together for a multi-layer screen 800. The layers are positioned so that wires in each layer align with wires in the other layers. As shown for a screen 800*a* with layers 801-803 in FIG. 7B, two amounts of adhesive 804 adhere the three layers together to maintain their relative position and the alignment of the wires. One, two, three, four or more amounts of adhesive (e.g. glue, hot melt glue, epoxy, adhesive, cement, plastic, thermoplastic) may be used.

Figure 7C:
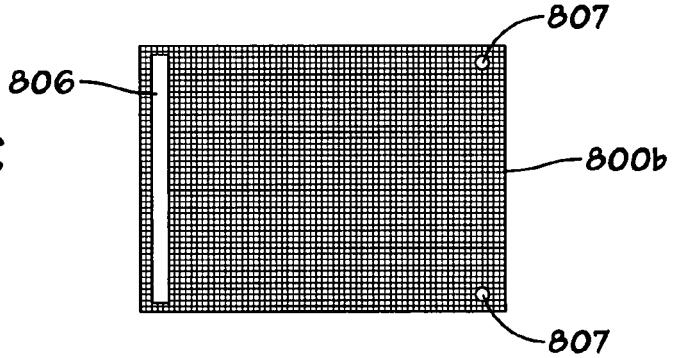
FIG. 7C is top view of a screen according to the present invention.

Optionally, or in addition to the amounts of adhesive 803, a staple or staples 805 may be used (or a rivet or rivets 807, as in FIG. 7C). Any suitable connector may be used (staple, rivet, clip, screw.

As show in FIG. 7C in a screen 800*b* with layers 801-803, a line of adhesive (e.g., but not limited to, a line 806 of hot melt glue) is applied to the layers 801-803 to connect them together. In any embodiment of the present invention an adhesive and/or a connector can be applied manually or by a machine.

In any embodiment of a multi-layer screen according to the present invention, the layers may be unconnected to each other or any two adjacent or all layers may be connected together.

In any screen according to the present invention with multiple layers, all layers can have wires of the same diameter or wires in each layer can be of different diameters.

In certain aspects placing one layer selected according to the present invention on top of another layer selected according to the present invention in combination results in desired alignment (e.g. before the combination of a panel having multiple openings with mesh layers) and/or the force of fluid and/or vibratory force contributes to this alignment. It is within the scope of the present invention by selecting wire screen layers as described above (any embodiment) with wire count ratios according to the present invention to achieve a substantial amount of wire alignment between wires of layers of screening material; e.g., in certain aspects, in a multi-layer screen according to the present invention, to achieve such alignment of at least 30%; of at least 50%; or, in some cases, at least 70%. The percentage of aligned wires in one direction achieved according to the present invention is based on the wire count ratio for that direction.

FIG. 8 illustrates one method according to the present invention for selecting layers of wire screening material for a screen according to the present invention having aligned wires according to the present invention. The method includes steps 1 to 9.

In step 1 a basis point is selected for the top layer of the screen—which determines whether it will be fine or coarse. In one aspect, a screen mesh can be selected with a top warp opening in microns between 25 to 500 microns.

Once the top warp opening size of the top layer is selected, a wire diameter for wires in the top layer is determined by multiplying the selected top warp opening size by a multiplier, e.g. between 0.1 to 1.1 (based on experience and desirable resulting wire diameters). In one particular aspect, no result finer than 0.0010 inches is used (step 2*a*).

In step 3 an aspect ratio is selected (in one aspect, in step 3*a*, between 0.25 to 4.00) with 1.0 being the aspect ratio for a square opening. Alternatively, in step 3*b*, a top layer warp weaving angle is selected, e.g. between 5 and 45 degrees.

At the end of step 3, the top layer's warp opening, wire diameter, and aspect ratio are determined.

Steps 4-6 deal with the middle layer of a three layer screen. In step 4 a count ratio is selected, the count ratio between the top warp wires (per unit length) and the middle warp wires (per unit length), with the numerator and denominator in each ratio being an integer or nearly an integer (e.g. within ±0.1 of an integer); in one aspect, with the integers between 1 and 10 and with the resulting count ratio being 0.1 to 10. Step 4, therefore, yields the warp count for the middle layer.

In step 5, the shute count for the middle layer is determined in a manner similar to that of step 4 for warp count.

In step 6, the diameter of the wires of the middle layer is determined by using step 6*a* or step 6*b*. In step 6*a* a constant ratio is chosen (based on experience) of top layer wire diameter to middle layer wire diameter, e.g. in a range between 0.2 to 5; or, in step 6*b*, a wire diameter is calculated based on results from step 1 (e.g. using a simple formula function based on the numerical result of step 1).

Steps 7-9 deal with the lowermost bottom layer of a three layer screen. In step 7 the lowermost layers warp count is determined (e.g. as in step 4, above for the middle layer), in one aspect, with integers ranging between 1 and 10. In step 8, the lowermost layer's shut count ratio is determined (e.g. as in step 5, above, for the middle layer). In step 9, the diameter of the wires of the lowermost layer is determined (e.g. as in step 6, above, for the middle layer).

FIG. 8A and 8B show values, measurements, and ratios for screens 1-6 according to the present invention determined with the method of FIG. 8. "TMDR Value" is top-to-middle diameter ratio. "MBDR Value" is middle-to-bottom diameter ratio.

Figure 9A:
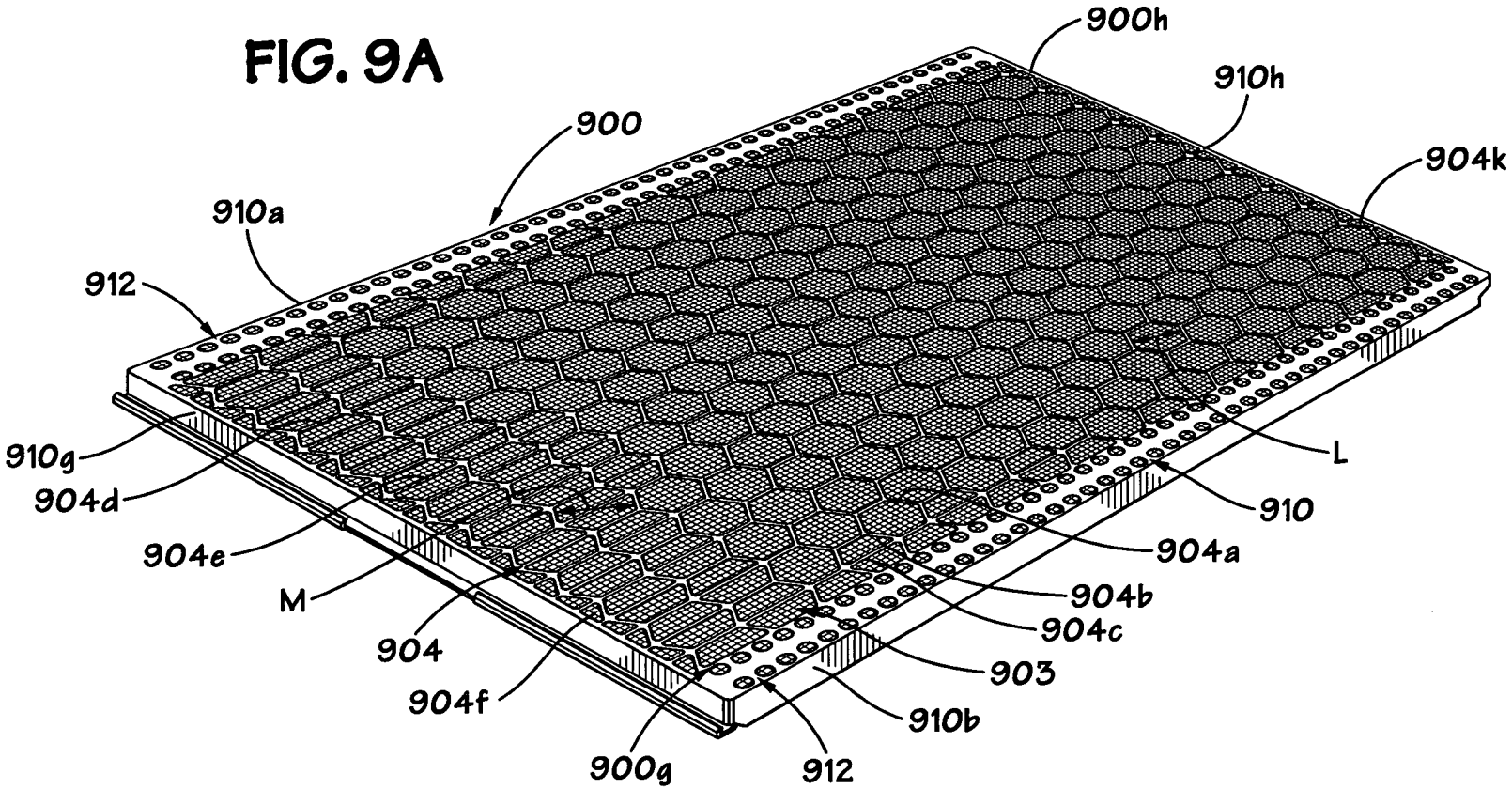
FIG. 9A is a perspective view of a screen assembly according to the present invention.
Figure 9B:
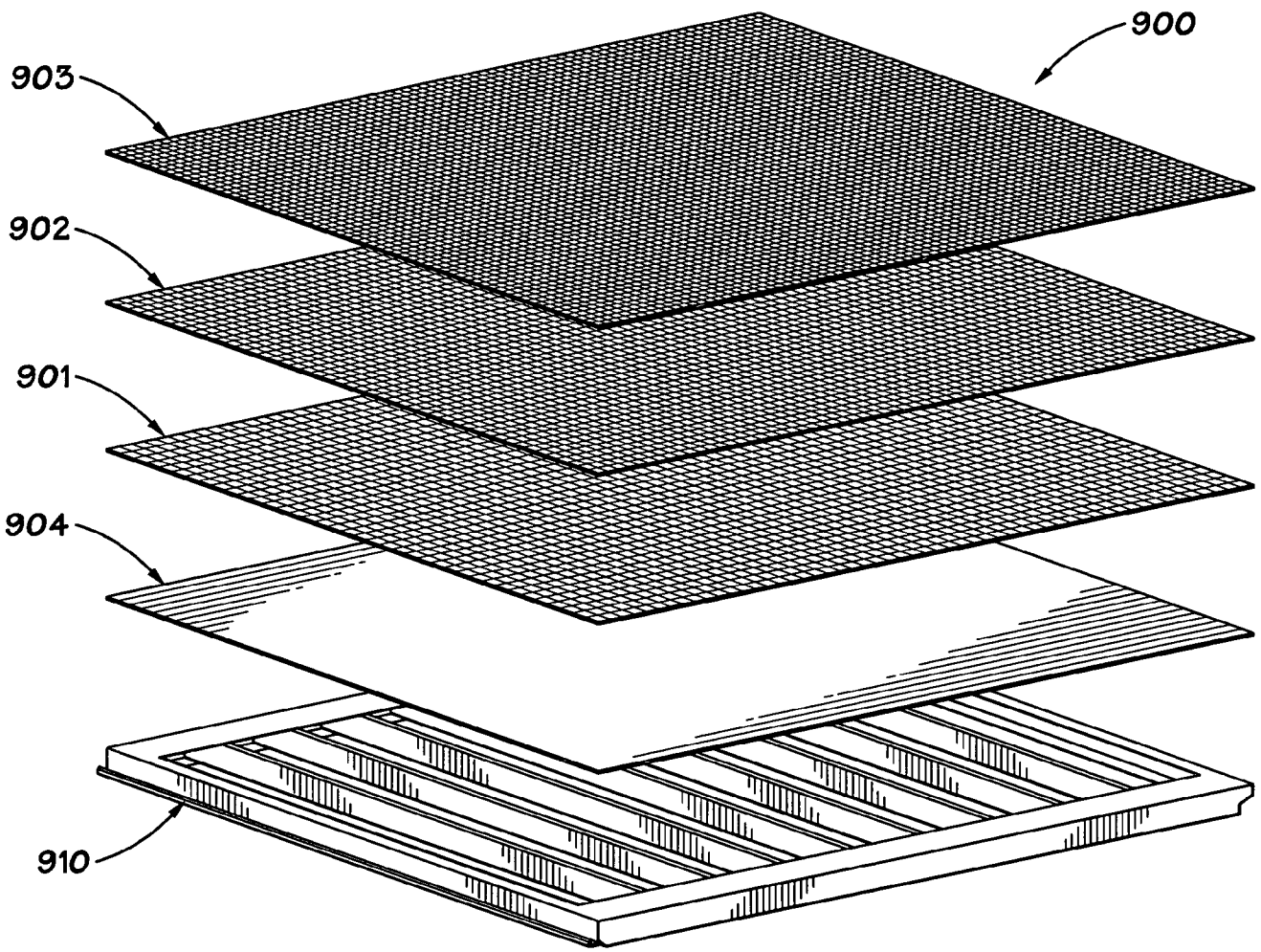
FIG. 9B is an exploded view of the screen assembly of FIG. 8A.

FIGS. 9A and 9B show a screen assembly 900 according to the present invention which has ends 900*g*, 900*h* and a frame 910 on which are secured a plurality of screening layers 901, 902, 903 with a panel 904 applied to the screening layers. In certain aspects the frame 910 is made of sheet metal, e.g. aluminum, stainless steel, or composite material, or fiberglass. The screening layers 901-903 are any suitable known screening material, e.g., but not limited to, screen cloth of multiple spaced-apart wires of stainless steel; and the panel 904 is any suitable material, e.g. mild steel or mild steel coated with cured epoxy. In FIG. 9B the layers 901-903, the panel 904, and the frame 910 are shown somewhat schematically without all the detail of other figures. Any one or two of the layers 901-903 may be deleted.

Peripheral edges of the panel 904 and/or of the screening layers 901-903 are connected, secured, and/or adhered to the sides 910*a*, 910*b* and the ends 910*g*, 910*h* of the frame 910. In one aspect, the panel edges and the screening layer edges are epoxied to the frame. Optionally, the frame 910 has a plurality of holes 912 (and the panel 904 has holes 912*p*) which receive an amount of epoxy that secures the screening layers. The holes 912, in one aspect, are not aligned with the holes 912*p*. In another aspect, the holes 912 and the holes 912*p* are aligned. The holes 912 go all the way through the frame but it is within the scope of the present invention for the holes 912 to project into the frame without penetrating all the way through.

Optionally, the panel 904 has the majority of its area formed with hexagonal openings 904*a*. Optionally, several of these openings, openings 904*b*, have a crossbar 904*c*, for added strength and wear resistance. The openings 904*b* extend along two sides of the screen assembly at locations of expected relatively high solids impact and/or locations of high accumulation of separated solids. Optionally, the panel 904 has elongated hexagon openings 904*d* (one or, as shown, two rows, or more rows) each with a crossbar 904*e* for added strength and wear resistance. Optionally the panel 904 has areas 904*f* at the end 904*g* adjacent the openings 904*d*. Relatively more panel material defines the openings 904*f*, hence, they present a stronger area to material flowing thereon. Also, a corresponding shape of the frame 910, edge 910*f*, underlies the areas 904*f* and there is no flow through the areas 904*f*. For example, in certain aspects, a screen assembly 900 is positioned on a vibratory separator or shale shaker so that material is fed to the screen assembly to initially fall on the end 900*g* at which the panel 904 has the openings 904*d* and/or areas 904*f* and/or openings 904*b* since the impact of the material and its effects can be greater at a feed end of the screen. An exit end 900*h* of the screen assembly may also have some or all of these areas and openings; as shown, the panel 904 at the exit end 900*h* has areas 904*k* (like the areas 904*f*). Optionally, the frame 910 includes then edge 910*f* which corresponds in shape to the areas 904*f*. Optionally, the frame 910 has a plurality of crossbars 910*s* (or crossmembers or cross strips).

Figure 9C:
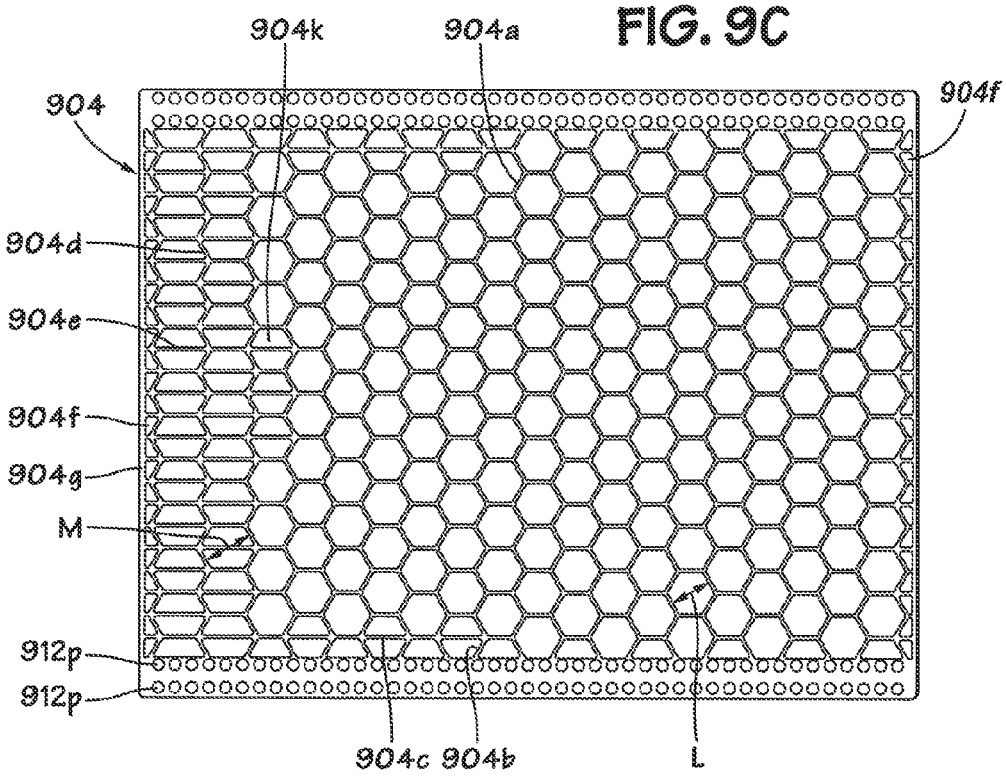
FIG. 9C is a top view of the screen assembly of FIG. 8A.
Figure 9D:
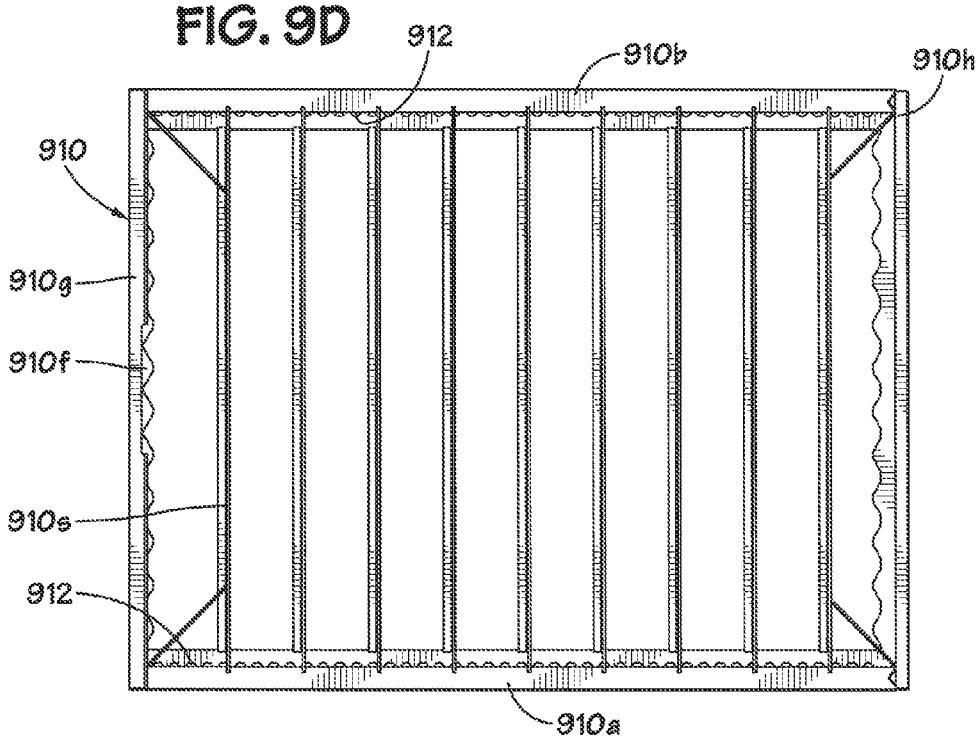
FIG. 9D is a top view of the frame of the screen assembly of FIG. 8A.
Figures 10A, 10B, 10C, 10D, 10E, 10F, 10G:
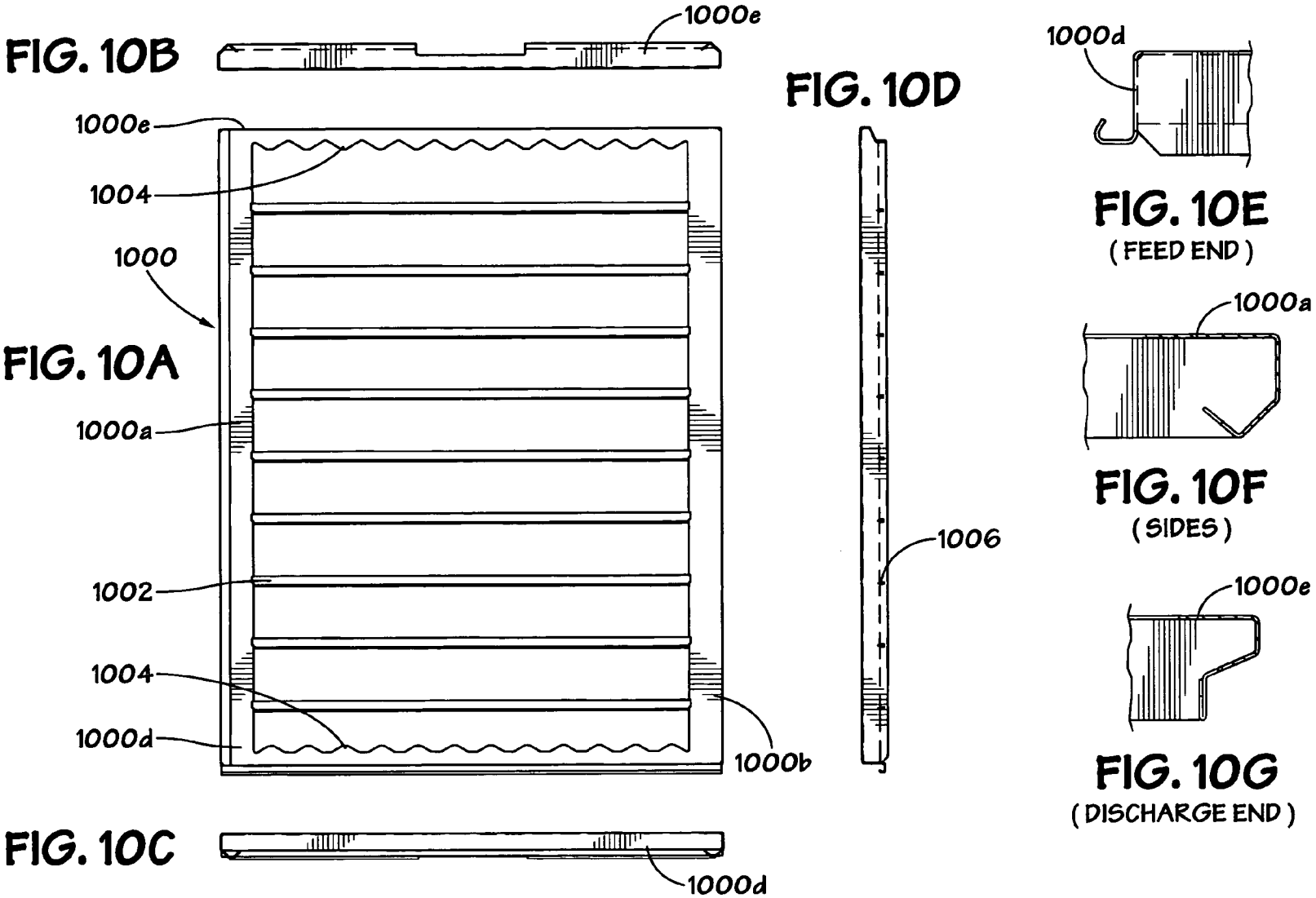
FIG. 10A is a top view of a frame for use with screens according to the present invention.
FIG. 10B is an end view of the frame of FIG. 10A.
FIG. 10C is an end view of the frame of FIG. 10A opposite the end of FIG. 10B.
FIG. 10D is a side view of the frame of FIG. 10A.
FIG. 10E is a cross-section view of a feed end of the frame of FIG. 10A.
FIG. 10F is a cross-section view of a side of the frame of FIG. 10A.
FIG. 10G is a cross-section view of a discharge end of the frame of FIG. 10A.

As shown in FIGS. 9A and 9C, in one particular aspect a screen according to the present invention has, as seen from above, a generally "W" shaped area that includes the areas 904*f*, the openings 904*b*, the openings 904*d*, and a plurality of central openings 904K (three shown) which cover a portion of the screen area which, in certain uses, is subjected to relatively increased impact, and/or relatively increased solids accumulation and/or wear, and/or relatively larger forces. The openings 904*b*, 904*d* and 904*k* each has a crossbar.

The openings of the panel 904 may be any desired shape as viewed from above and crossbars may be used with any shape. Any shape may be used for the majority of the panels area with elongated shapes used at certain areas, e.g. at one or both ends. In one particular aspects, the openings 904*a* are regular hexagons with a side-to-side length L of 1.83 inches which is about 8% larger than the side-to-side length of some commonly-used hexagonal panel openings.

In certain aspects, the elongated hexagonal openings 904*d* have a side-to-side length that is at least 15% greater than a comparable non-elongated hexagon. In one particular aspect, with a side-to-side length between elongated sides which are 1.83 inches apart, the side-to-side length M is 2.198 inches.

In certain aspects, a panel with hexagon openings with a larger side-to-side length L is used with one or more screening material layers which have wires of relatively larger diameter; e.g., see screens 1-6 as described in FIGS. 8A, 8B.

In certain aspects, in screen assemblies according to the present invention in which wires with relatively larger diameters are used, the wires are spaced-apart a relatively larger distance so that screen open area is not significantly reduced because of the use of larger wires; for example, see screens 1-6, FIGS. 8A, 8B.

In certain aspects, screen assemblies according to the present invention have a top layer of wire screening material that has generally square openings and a lower layer beneath the top layer which has non-square rectangular openings. In certain aspects, in such a screen assembly according to the present invention the ratio of wire count (number of wires per unit of length) for the top layer to wire count for the middle layer (or bottom layer if there are only two layers) is a ratio of whole numbers, whether or not there is a whole number of wires per inch in each layer.

In one particular embodiment the wires of screens are in a 1.5:1 ratio in one direction and a 2.5:1 ratio in the other direction so that across the first direction 1 of 3 openings formed by the top mesh are unobstructed by a wire in the second mesh in that direction, while in the other direction 3 of 5 openings formed by the top mesh are unobstructed by a wire in the second mesh in that direction. In this particular embodiment, when these ratios are maintained, the middle mesh has a count ratio (warp to shute) of 1.7:1.

In one particular screen assembly according to the present invention ("Embodiment A"), the screen assembly has three layers of screening material, each with wires of stainless steel, including a lowermost layer of tensile bolting cloth ("TBC"), a middle layer with generally non-square rectangular openings; and a top layer with generally square openings. The wire count for each layer and warp and shute wire diameters are as follows:

| Embodiment A | | | | |
|---|---|---|---|---|
| | Mesh Type | | | |
| | Warp | | Shute | |
| | Count | Diameter | Count | Diameter |
| TBC layer | 120 | .0026" | 120 | .0026" |
| Middle layer | 74 | .0036" | 44 | .0036" |
| Top layer | 111 | .0025" | 111 | .0025" |

In such a screen assembly, the mesh count of the top layer is lower than the mesh count of the TBC layer (with similar wire diameters) so the weaving angles of the top layer are generally less and, therefore, the wires of the top layer can move relatively more than the wires of the TBC layer. Comparable previous known screen assemblies ("B" and "C" below) have the following characteristics for top and middle layers (employing the same TBC lowermost layer):

| B: Square Openings: Top & Mid Layers | | | | |
|---|---|---|---|---|
| | Mesh Type | | | |
| | Warp | | Shute | |
| | Count | Diameter | Count | Diameter |
| Top layer | 130 | .0017" | 130 | .0017" |
| Middle layer | 100 | .0023" | 100 | .0025" |

| C: Rectangular Openings: Top & Mid Layers | | | | |
|---|---|---|---|---|
| | Mesh Type | | | |
| | Warp | | Shute | |
| | Count | Diameter | Count | Diameter |
| Top layer | 170 | .0017" | 105 | .0017" |
| Middle layer | 105 | .0025" | 64 | .0025" |

The screen assembly of Embodiment A according to the present invention has a top square opening mesh layer which is more stable than the rectangular openings of the C screen assembly since less relative movement of wires occurs with square openings. By using a wire diameter (e.g. 0.0025") for the top layer that is relatively larger than the wire diameters of the top layers of screen assemblies B and C (0.0017"), the strength of the top layer of the screen assembly according to the present invention is increased. A layer in a screen according to the present invention with "square" openings has openings that are square within manufacturing tolerances; i.e., the square openings may not be exact perfect squares.

In any of these screen assemblies according to the present invention the top, middle, and/or lowermost support layers can be calendared. Calendaring can enhance wire alignment.

In certain screen assemblies according to the present invention (one example being Embodiment A above), the top layer has a mesh wire count ratio of 1:1 (i.e., for a 1:1 ratio, the ratio of the number of wires in one direction is the same as the number of wires in the other direction) or nearly 1:1 (ratio X), e.g. 1:0.9; the wire count ratio (ratio Y) in a first direction of two directions (warp or shute) between the top layer and the layer below the top layer (e.g. a middle layer), is between 1.25:1 and 1.75:1; and the count ratio (ratio Z) between the top layer and layer below the top layer in the second of the two directions is between 2.25 and 2.75. In such screen assemblies the wire diameters of wires in the top layer and the layer below the top layer can be different or the same. In one particular embodiment, specific ratios are as follows:

| | |
|---|---|
| Ratio X | 1:1 |
| Ratio Y | 1.5:1 |
| Ratio Z | 2.5 |

In certain aspects, wire diameter for wires in a top layer range between 0.0011 to 0.0055 inches and wire diameter for wires in a middle layer range between 0.0011 to 0.0055 inches; and wire diameter ratios, top wire diameter to middle wire diameter, range between 0.72 and 0.68. In certain aspects the wire diameter of wires in a top layer are not smaller than 0.0010".

FIGS. 10A-10G show a frame 1000 which can be used with the screen of FIG. 8A (or any screen according to the present invention). The frame 1000 has sides 1000*a*, 1000*b* and ends 1000*d*, 1000*e*. In one aspect the end 1000*d* is a feed end for the screen 1000 and end 1000*e* is a discharge end. The frame 1000 has cross supports 1002 and scalloped edges 1004. Optionally, a lower series of cross-supports 1006 are also used which extend across the frame 1000 as do the cross supports 1002.

The present invention, therefore, provides in at least certain embodiments, a screen for a vibratory separator, the screen having at least two layers of screening material, the at least two layers of screening material including a first layer and a second layer, the first layer made of a plurality of intersecting first wires, the second layer made of a plurality of intersecting second wires, the first layer above the second layer, each of a plurality of the first wires aligned with a corresponding second wire according to a preselected wire count ratio, a panel combined with the at least two layers of screening material, the panel having multiple spaced-apart openings, a plurality of the multiple spaced-apart openings having a central cross-member extending from a first side of an opening to a second side thereof, said plurality of openings in a pattern on the panel as viewed from above, and a support for the panel and the at least two layers of screening material. Such a screen may have one or some, in any possible combination, of the following: wherein the vibratory separator is a shale shaker for use on a drilling rig; wherein the at least two layers of screening material includes a third layer, the third layer below the second layer and made of a plurality of intersecting third wires, each of a plurality of the first wires aligned with a corresponding third wire, each of a plurality of the second wires aligned with a corresponding third wire; wherein the multiple spaced-apart openings include a plurality of openings with a regular hexagonal shape; wherein a side-to-side length across one of the regular hexagonal openings is 1.83 inches; wherein the plurality of the multiple spaced-apart openings includes a plurality of openings with an elongated hexagonal shape; wherein a side-to-side length across one of the elongated hexagonal openings is 2.19 inches; wherein the pattern includes high impact areas of the screen; wherein the high impact areas include a feed end of the screen, a central area of the screen adjacent the feed end, and two side areas of the screen each adjacent the feed end; wherein the support is a frame; wherein the support has two spaced-apart ends, each of the two spaced-apart ends having a shaped edge, the shaped edge having a shape corresponding to a shape of a portion of the multiple spaced-apart openings; and/or wherein the shaped edges block flow through the at least two layers of screening material.

The present invention, therefore, provides in at least certain embodiments, a screen for a vibratory separator, the screen having at least two layers of screening material, the at least two layers of screening material including a first layer and a second layer, the first layer made of a plurality of intersecting first wires, the second layer made of a plurality of intersecting second wires, the first layer above the second layer, each of a plurality of the first wires aligned with a corresponding second wire according to a preselected wire count ratio, a panel combined with the at least two layers of screening material, the panel having multiple spaced-apart openings, a plurality of the multiple spaced-apart openings having a central cross-member extending from a first side of an opening to a second side thereof, said plurality of openings in a pattern on the panel as viewed from above, a support for the panel and the at least two layers of screening material, wherein the at least two layers of screening material includes a third layer, the third layer below the second layer and made of a plurality of intersecting third wires, each of a plurality of the first wires aligned with a corresponding third wire, each of a plurality of the second wires aligned with a corresponding third wire, and wherein the pattern includes high impact areas of the screen.

The present invention, therefore, provides in at least certain embodiments, a screen for a vibratory separator, the screen having at least two layers of screening material, the at least two layers of screening material including a first layer and a second layer, the first layer made of a plurality of intersecting first wires, the second layer made of a plurality of intersecting second wires, the first layer above the second layer, the first layer having a warp-to-shute wire count ratio A between 0.9 and 1.1, a wire count ratio B in a first direction between the first layer and the second layer is between 1.25:1 and 1.75:1, and a wire count ratio C in a second direction different than the first direction between the top layer and the second layer is between 2.25 and 2.75. Such a screen may have one or some, in any possible combination, of the following: wherein the ratio A is 1:1, the ratio B is 1.5:1, and the ratio C is 2.5; wherein wires in the first layer range in diameter in inches between 0.0011 and 0.0055, wires in the second layer range in diameter in inches between 0.0011 and 0.0055, and a ratio of diameters of wires of the first layer to diameters of wires in the second layer ranges between 0.72 and 0.68; wherein the first layer and the second layer are calendared together; wherein the vibratory separator is a shale shaker for use on a drilling rig; and/or wherein the at least two layers of screening material includes a third layer of screening material.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A device, comprising:

a panel having a feed end, an exit end, and two laterally spaced-apart sides extending between said feed end and said exit end, said panel comprising:

a plurality of first openings having a first shape and being arranged in a pattern on said panel, said pattern comprising a first group of said first openings that is positioned adjacent to said feed end and two second groups of said first openings that are positioned adjacent to each of a respective one of said two laterally spaced-apart sides, wherein said first group of said first openings extends substantially from said feed end to a first distance from said feed end and at least one of said two second groups of said first openings extends substantially from said first distance to at least a second distance from said feed end that is greater than said first distance; and a plurality of second openings having a second shape that is different from said first shape, wherein a group of said second openings is positioned between said first group of said first openings and said exit end, and at least some of said second openings comprising said group of said second openings are positioned between each of said two second groups of said first openings.

2. The device of claim 1, wherein said device comprises a screen assembly for a vibratory separator, the screen assembly further comprising at least one layer of screening material positioned above said panel and a support frame positioned below said panel, wherein said support frame is adapted to support said panel and said at least one layer of screening material.

3. The device of claim 2, wherein said at least one layer of screening material comprises:

a first layer of screening material comprising a plurality of intersecting first wires; and a second layer of screening material comprising a plurality of intersecting second wires, wherein each of a first number of said first wires is aligned with a corresponding one of said second wires at a predetermined angle relative to a plane of said screen assembly, and wherein said first number of said first wires aligned with said corresponding second wires is based on a first preselected wire count ratio.

4. The device of claim 3, wherein said predetermined angle is substantially perpendicular to said plane of said screen assembly.

5. The device of claim 3, wherein said predetermined angle is substantially aligned with a force vector imparted to said screen assembly by said vibratory separator.

6. The device of claim 3, wherein said at least one layer of screening material further comprises a third layer of screening material comprising a plurality of intersecting third wires, wherein each of a second number of said first wires is aligned with a corresponding one of said third wires at said predetermined angle, said second number based on a second preselected wire count ratio, and wherein each of a third number of said second wires is aligned with a corresponding one of said third wires at said predetermined angle, said third number based on a third preselected wire count ratio.

7. The device of claim 2, wherein said frame support comprises a shaped edge at each of said feed end and said exit end of said panel, said shaped edge at said feed end corresponding to a shape of a portion of said plurality of first openings and said shaped edge at said exit end corresponding to a shape of a portion of said plurality of second openings.

8. The device of claim 7, wherein said shaped edge is adapted to block a flow of material through said screen assembly.

9. The device of claim 1, wherein said first shape is a trapezoidal shape and said second shape is a hexagonal shape.

10. The device of claim 9, wherein at least some of said hexagonally shaped openings comprise regular hexagonally shaped openings.

11. The device of claim 10, wherein a dimension from side to side across at least one of said regular hexagonally shaped openings is approximately 1.83 inches.

12. The device of claim 9, wherein a size of at least some of said plurality of first openings having said trapezoidal shape is substantially one-half of a size of at least some of said plurality of second openings having said hexagonal shape.

13. The device of claim 1, wherein said first group of said first openings extends substantially from a first one of said two laterally spaced apart sides to a second one of said two laterally spaced-apart sides.

14. The device of claim 1, wherein said pattern further comprises a third group of said first openings positioned adjacent to said first group of said first openings, and wherein said third group of said first openings extends substantially from said first distance to a third distance from said feed end that is greater than said first distance.

15. The device of claim 14, wherein said third distance is less than said second distance.

16. The device of claim 14, wherein at least some of said plurality of second openings are positioned between said third group of said first openings and each of said two second groups of said first openings.

17. The device of claim 1, wherein each one of said two second groups of said first openings extends substantially a distance from a respective one of said two laterally spaced-apart sides that is less than one-half of a distance between said two laterally spaced-apart sides.

18. The device of claim 1, wherein said panel comprises a plurality of structural members, and wherein said first and second shapes of said respective first and second openings are defined by said plurality of structural members.

19. The device of claim 18, wherein said plurality of structural members defining said plurality of first openings has a first spacing density, and said plurality of structural members defining said plurality of second openings has a second spacing density that is different than said first spacing density.

20. The device of claim 1, wherein a size of each of said first openings comprising said two second groups of said first openings is smaller than a size of each of said first openings comprising said first group of said first openings.

21. The device of claim 1, wherein said group of said second openings extends substantially from a first one of said two second groups of said first openings to a second one of said two second groups of said first openings.

22. The device of claim 1, wherein said group of said second openings extends substantially from said first distance to said exit end of said panel.

23. A screen assembly for a vibratory separator, the screen assembly comprising:

a panel having a feed end, an exit end, and two laterally spaced-apart sides extending between said feed end and said exit end, wherein a length of at least one of said feed and exit ends defines a width of said panel, said panel comprising:

a plurality of first openings having a first shape and being arranged in a pattern on said panel, said pattern comprising a first group of said first openings that is positioned adjacent to said feed end and two second groups of said first openings that are positioned adjacent to each of a respective one of said two laterally spaced-apart sides, wherein said first group of said first openings extends substantially from said feed end to a first distance from said feed end and at least one of said two second groups of said first openings extends substantially from said first distance to a second distance from said feed end that is greater than said first distance, each one of said two second groups of said first openings further extending a third distance from a respective one of said two laterally spaced-apart sides that is less than one-half of said width of said panel; and a plurality of second openings having a second shape that is different than said first shape, wherein a group of said second openings is positioned between said first group of said first openings and said exit end, and at least some of said second openings comprising said group of said second openings are positioned between each of said two second groups of said first openings;

at least one layer of screening material positioned above said panel; and a support frame positioned below said panel, wherein said support frame is adapted to support said panel and said at least one layer of screening material.

24. The screen assembly of claim 23, wherein said at least one layer of screening material comprises:

a first layer of screening material comprising a plurality of intersecting first wires having a warp-to-shute wire count ratio between 0.9:1 and 1.1:1; and a second layer of screening material comprising a plurality of intersecting second wires, wherein each of a first number of said first wires in a first direction is aligned with a corresponding one of said second wires in said first direction at a predetermined angle relative to a plane of said screen assembly, said first number based on a first preselected wire count ratio between 1.25:1 and 1.75:1, and wherein a second number of said first wires in a second direction other than said first direction is aligned with a corresponding one of said second wires in said second direction at said predetermined angle, said second number based on a second preselected wire count ratio between 2.25:1 and 2.75:1.

25. The screen assembly of claim 24, wherein said warp-to-shute wire count ratio of said first layer of screening material is approximately 1:1, said first preselected wire count ratio is approximately 1.5:1, and said second preselected wire count ratio is approximately 2.5:1.

26. The screen assembly of claim 24, wherein wires comprising said first and second layers of screening material each have a diameter ranging from 0.0011 inches to 0.0055 inches, and a diameter ratio of wires comprising said first layer to wires comprising said second layer ranges from 0.68 to 0.72.

27. The screen assembly of claim 24, wherein said first and second layers of screening material are calendared together.

28. The screen assembly of claim 24, further comprising a third layer of screening material.

29. The screen assembly of claim 23, wherein said first shape is a trapezoidal shape and said second shape is a hexagonal shape, and wherein said first size of at least some of said trapezoidally shaped openings is substantially one-half of said second size of at least some of said hexagonally shaped openings.

* * * * *